US005360709A

United States Patent [19]

Ohkawa et al.

[11] Patent Number: 5,360,709

[45] Date of Patent: Nov. 1, 1994

[54] SILVER HALIDE PHOTOGRAPHIC MATERIAL CONTAINING A DIR COMPOUND

[75] Inventors: Atsuhiro Ohkawa; Masuji Motoki; Keiji Mihayashi, all of Kanagawa, Japan

[73] Assignee: Fuji Photo Film Co., Ltd., Kanagawa, Japan

[21] Appl. No.: 37,680

[22] Filed: Mar. 25, 1993

Related U.S. Application Data

[63] Continuation of Ser. No. 642,265, Jan. 16, 1991, abandoned.

[30] Foreign Application Priority Data

Jan. 17, 1990 [JP] Japan ..... 2-7481
Nov. 27, 1990 [JP] Japan ..... 2-324608

[51] Int. Cl.[5] ..... G03C 7/305
[52] U.S. Cl. ..... 430/544; 430/957
[58] Field of Search ..... 430/544, 957, 552–558

[56] References Cited

U.S. PATENT DOCUMENTS 4,818,664 4/1989 Burns et al. ..... 430/543
4,861,701 8/1989 Ueda et al. ..... 430/430
4,962,018 10/1990 Szajewski et al. ..... 430/544

FOREIGN PATENT DOCUMENTS 318992 6/1989 European Pat. Off. .
348139 12/1989 European Pat. Off. .
362870 4/1990 European Pat. Off. .
2291645 12/1987 Japan .
3006550 1/1988 Japan ..... 430/544
1243058 9/1989 Japan .
1266540 10/1989 Japan ..... 430/544
2044338 2/1990 Japan ..... 430/544

*Primary Examiner*—Lee C. Wright
*Attorney, Agent, or Firm*—Sughrue, Mion, Zinn, Macpeak & Seas

[57] ABSTRACT

A silver halide color photographic material comprising on a support at least a silver halide emulsion layer, comprising a compound represented by general formula (I):

$$A-(L)_r-INH-(CH_2)_n-Q \quad (I)$$

wherein A represents a coupler residue excepting 1H-pyrazolo[1,5-b]-1,2,4-triazole and 1H-pyrazolo[5,1-c]-1,2,4-triazole; L represents a timing group or a group which reduces an oxidation product of a developing agent; r represents an integer of 2 to 4; n represents an integer of 0 to 3; Q represents a group having a molecular weight of 80 to 250; and INH represents a development inhibitor residue bonded to $A-(L)_r$ via hetero atoms and selected from a group (INH-1)

(INH-2)

(INH-3)

(INH-4)

(Abstract continued on next page.)

-continued
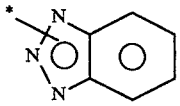
(INH-12)
wherein * represents the position at which the group is connected to L and ** represents the position at which the group is connected to —$(CH_2)_n$—Q.
6 Claims, No Drawings

SILVER HALIDE PHOTOGRAPHIC MATERIAL CONTAINING A DIR COMPOUND

This s a continuation of application Ser. No. 07/642,265, filed Jan. 16, 1991, now abandoned.

FIELD OF THE INVENTION

The present invention relates to a silver halide color photographic material comprising a novel compound capable of releasing a development inhibitor having a development inhibiting effect at opportune times during development.

BACKGROUND OF THE INVENTION

In the field of silver halide photographic materials, particularly for photographing, photographic materials having high sensitivity, an ISO sensitivity of at least 100 as in ISO 400 (Super HG-400 manufactured by Fuji Photo Film Co., Ltd.) and excellent graininess, sharpness and preservability have been heretofore desired.

As examples of means for improving sharpness, couplers which undergo a coupling reaction with an oxidation product of a developing agent to produce a cleaved compound which is in turn oxidized with a second oxidation product of a second developing agent to release a development inhibitor containing a timing group are disclosed in JP-A-61-231553 and JP-A-61-240240 (the term "JP-A" as used herein refers to a "published unexamined Japanese patent application"). However, there are disadvantageous as the couplers release development inhibitor at an inappropriate rate, leaving to be desired improvement in sharpness, preservability, etc., of the light-sensitive material.

As examples of compounds which improve sharpness without deteriorating the preservability of light-sensitive materials, compounds which imagewise release a development inhibitor via two or more timing groups are described in JP-A-60-218645, JP-A-60-249148 and JP-A-61-156127 and U.S. Pat. No. 4,861,701. However, these compounds do not provide a satisfactory improvement in sharpness and graininess due to an inappropriate speed (timing) of releasing development inhibitor or the excessively great dispersibility of the development inhibitor thus released. Most of the light-sensitive materials comprising said compounds are disadvantageous in that when allowed to stand for a prolonged period of time before development following exposure to light or when exposed to elevated temperature and high humidity, the result is a rise in fogging and a drop in sensitivity.

European Patent Publication 348,139 discloses couplers capable of releasing a development inhibitor in a specified structure such that sharpness can be improved without heightening interimage effect. Although the couplers enable some improvement in sharpness, the couplers are disadvantageous in that the speed of releasing a development inhibitor can be hardly controlled, leaving to be desired improvement in sharpness and causing some fluctuation in photographic properties with time between exposure and development, temperature and humidity.

SUMMARY OF THE INVENTION

It is an object of the present invention to provide a silver halide color photographic material which exhibits excellent sharpness and graininess and little fluctuation in photographic properties during aging between photographing (exposure) and development.

It is another object of the present invention to provide a silver halide color photographic material in which the rate of releasing development inhibitor can be controlled easily.

These and other objects of the present invention will become more apparent from the following detailed description and examples.

The above objects of the present invention are accomplished with a silver halide color photographic material comprising on a support at least a silver halide emulsion layer, characterized in that there is present a compound represented by general formulae (I):

$$A-(L)_r-INH-(CH_2)_n-Q \qquad (I)$$

wherein A represents a coupler residue excepting 1H-pyrazolo[1,5-b]-1,2,4-triazole and 1H-pyrazolo[5,1-c]-1,2,4-triazole; L represents a timing group or a group which reduces an oxidation product of a developing agent; r represents an integer of 2 to 4; n represents an integer of 0 to 3; Q represents a group having a molecular weight of 80 to 250; and IHN represents a development inhibitor residue bonded to A-(L), via heterto atoms.

DETAILED DESCRIPTION OF THE INVENTION

In general formula (I), A represents a coupler residue excepting 1H-pyrazolo[1,5-b]-1,2,4-triazole and 1H-pyrazolo[5,1-c]-1,2,4-triazole.

Examples of the coupler residue include yellow coupler residues (e.g., closed chain ketomethylene), magenta coupler residues (e.g., 5-pyrazolone, pyrazoloimidazole), cyan coupler residues (e.g., phenolic, naphtholic), and colorless coupler residues (e.g., indanone, acetophenone). Furthermore, heterocyclic coupler residues as disclosed in U.S. Pat. Nos. 4,315,070, 4,183,752, 3,961,959, and 4,171,223 may be used.

Preferred examples of coupler residues represented by A include those represented by general formulae (Cp-1), (Cp-2), (Cp-3), (Cp-6), (Cp-7), (Cp-8), (Cp-9), and (Cp-10). These coupler residues are advantageous in that they undergo coupling at a high speed.

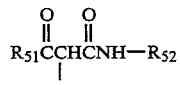
(Cp-1)

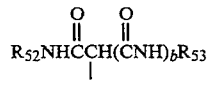
(Cp-2)

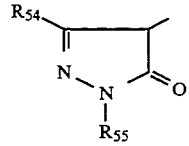
(Cp-3)

-continued (Cp-6)

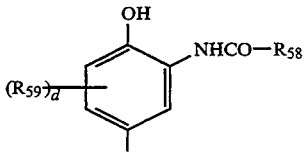

(Cp-7)

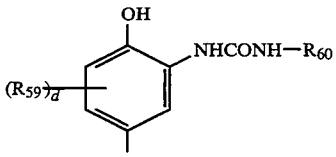

(Cp-8)

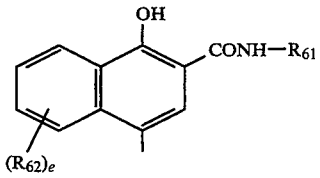

(Cp-9)

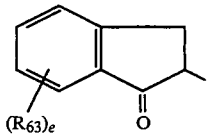

(Cp-10)

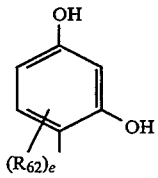

In the above general formulae, the free bonds in the coupling position each represents a position to which a coupling separable group is bonded.

In the above general formulae, if $R_{51}$, $R_{52}$, $R_{53}$, $R_{54}$, $R_{55}$, $R_{58}$, $R_{59}$, $R_{60}$, $R_{61}$, $R_{62}$ or $R_{63}$ contains a nondiffusible group, the total number of carbon atoms contained in the coupler residue is 8 to 40, preferably 10 to 30. If no nondiffusible group is present, the total number of carbon atoms contained in the coupler residue is preferably 15 or less. In the case of a bis type, telomer type or polisher type couplers, any one of the above mentioned substituents represents a divalent group which connects repeating units. In this case, the number of carbon atoms may deviate from the above disclosed range.

$R_{51}$ to $R_{55}$, $R_{58}$ to $R_{63}$, b, d and e will be further described hereinafter.

$R_{41}$ represents an aliphatic group, an aromatic group or a heterocyclic group; $R_{42}$ represents an aromatic group or a heterocyclic group; and $R_{43}$, $R_{44}$ and $R_{45}$ each represents a hydrogen atom, an aliphatic group, an aromatic group or a heterocyclic group.

$R_{51}$ has the same meaning as $R_{41}$. The suffix b represents an integer of 0 or 1. $R_{52}$ and $R_{53}$ each has the same meaning as $R_{42}$. $R_{54}$ has the same meaning as $R_{41}$ or represents an

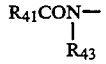

group, an

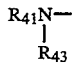

group, an

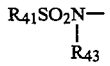

group, an $R_{41}S$— group, an $R_{43}O$— group, an

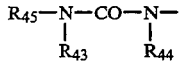

group or an N≡C— group. $R_{55}$ has the same meaning as $R_{41}$. $R_{58}$ has the same meaning as $R_{41}$. $R_{59}$ has the same meaning as $R_{41}$ or represents an

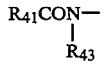

group, an

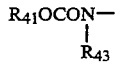

group, an

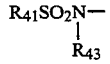

group, an

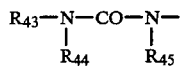

group, an $R_{41}O$— group, an $R_{41}S$— group, a halogen atom, or an

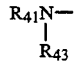

group. The suffix d represents an integer of 0 to 3. When d is plural, each $R_{59}$ represents the same or different substituents. Alternatively, each $R_{59}$ may be a divalent group and may be connected to each other to form a cyclic structure. Typical examples of divalent groups to be used for the formation of a cyclic structure include an 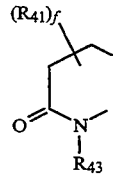 group, or an 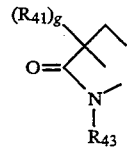 group, wherein f represents an integer of 0 to 4; and g represents an integer of 0 to 2. $R_{60}$ has the same meaning as $R_{41}$. $R_{61}$ has the same meaning as $R_{41}$. $R_{62}$ has the same meaning as $R_{41}$ or represents an $R_{41}OCONH$— group, an

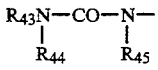

group, an

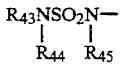

group, an $R_{43}O$—group, and $R_{41}S$— group, a halogen atom or an

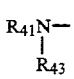

group. $R_{63}$ has the same meaning as $R_{41}$ or represents an

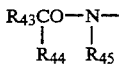

group, an

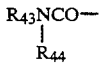

group, an

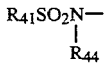

group, an

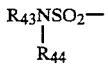

group, an $R_{41}SO2N$— group, an $R_{43}OCO$— group, an $R_{43}O—SO_2$— group, a halogen atom, a nitro group, a cyano group or an $R_{43}CO$— group. The suffix e represents an integer of 0 to 4. When there are a plurality of $R_{62}$'s or $R_{63}$'s, each $R_{62}$ or $R_{63}$ may be the same or different.

The above mentioned aliphatic group represented by $R_{41}$ and $R_{43}$ to $R_{45}$ is a $C_{1-32}$, preferably a $C_{1-22}$ saturated or unsaturated, straight chain or branched chain or cyclic, substituted or unsubstituted aliphatic hydrocarbon group. Typical examples of such an aliphatic hydrocarbon group include methyl, ethyl, propyl, isopropyl, butyl, t-butyl, i-butyl, t-amyl, hexyl, cyclohexyl, 2-ethylhexyl, octyl, 1,1,3,3-tetramethylbutyl, decyl, dodecyl, hexadecyl, and octadecyl.

The above mentioned aromatic group represented by $R_{41}$ to $R_{45}$ is a $C_{6-20}$, preferably a substituted or unsubstituted phenyl group or a substituted or unsubstituted naphthyl group.

The above mentioned heterocyclic group represented by $R_{41}$ to $R_{45}$ is a $C_{1-20}$, preferably a $C_{1-7}$ 3- to 8-membered substituted or unsubstituted heterocyclic group containing a hetero atom selected from a nitrogen atom, an oxygen atom and a sulfur atom. Typical examples of such a heterocyclic group include 2-pyridyl, 2-thienyl, 2-furyl, 1,3,4-thiadiazole-2-yl, 2,4-dioxo-1,3-imidazolidine-5-yl, 1,2,4-triazole-2-yl, and 1-pyrazolyl.

Typical examples of substituents to be contained in the above mentioned substituted aliphatic hydrocarbon group, aromatic group and heterocyclic group include a halogen atom, an $R_{47}O$— group, an $R_{46}S$— group, an

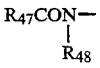

group, an

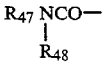

group, an

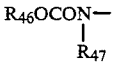

group, an

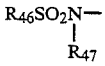

group, an

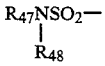

group, an $R_{46}SO_2$— group, an $R_{47}OCO$— group, an

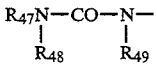

group, an $R_{46}$ group, an

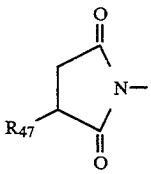

group, an $R_{46}COO$— group, an $R_{47}OSO_2$— group, a cyano group, and a nitro group, in which $R_{46}$ represents an aliphatic group, an aromatic group or a heterocyclic group, and $R_{47}$, $R_{48}$ and $R_{49}$ each represents an aliphatic group, an aromatic group, a heterocyclic group or a hydrogen atom. The aliphatic group, aromatic group or heterocyclic group represented by $R_{46}$, $R_{47}$ and $R_{48}$ is as defined above for $R_{41}$ to $R_{45}$.

Preferred examples of $R_{51}$ to $R_{55}$, $R_{58}$ to $R_{63}$, d and e will be described hereinafter.

$R_{51}$ is preferably an aliphatic or aromatic group. $R_{52}$, $R_{53}$ and $R_{55}$ are preferably aromatic groups. $R_{54}$ is preferably an $R_{41}CONH$— group or an $$R_{41}-\underset{\underset{R_{43}}{|}}{N}-$$

group. $R_{58}$ is preferably an aliphatic group or an aromatic group.

In general formula (Cp-6), $R_{59}$ is preferably a chlorine atom, an aliphatic group or an $R_{41}CONH$— group. The suffix d is preferably 1 or 2. $R_{60}$ is preferably an aromatic group.

In general formula (Cp-7), $R_{59}$ is preferably an $R_{41}CONH$— group. In general formula (Cp-7), the suffix d is preferably 1.

In general formula (Cp-8), $R_{61}$ is preferably an aliphatic group or an aromatic group. In general formula (Cp-8), the suffix e is preferably 0 or 1. $R_{62}$ is preferably an $R_{41}OCONH$— group, an $R_{41}CONH$— group or an $R_{41}SO_2NH$— group. $R_{62}$ preferably substitutes for the hydrogen atom in the 5-position of the naphthol ring.

In general formula (Cp-9), $R_{63}$ is preferably an $R_{41}CONH$— group, an $R_{41}SO_2NH$— group, an $$R_{41}\underset{\underset{R_{43}}{|}}{N}SO_2-$$

group, an $R_{41}SO_2$— group, an $$R_{41}\underset{\underset{R_{43}}{|}}{N}CO-$$

group, a nitro group or a cyano group. In general formula (Cp-9), the suffix e is preferably 1 or 2.

In general formula (Cp-10) $R_{63}$ is preferably an $$R_{43}\underset{\underset{R_{43}}{|}}{N}CO-$$

group, an $R_{43}CCO$— group or an $R_{43}CO$— group. In general formula (Cp-10), the suffix e is preferably 1 or 2.

Typical examples of $R_{51}$ to $R_{55}$ and $R_{58}$ will be further described hereinafter.

Examples of $R_{51}$ include a t-butyl group, a 4-methoxyphenyl group, a phenyl group, a 3-[2-(2,4-di-t-amylphenoxy)butanamido]phenyl group, and a methyl group.

Examples of $R_{52}$ and $R_{53}$ include a phenyl group, a 2-chloro-5-ethoxy group, a 2-chloro-5-dodecyloxycarbonylphenyl group, a 2-chloro-5-hexadecylsulfonamidophenyl group, a 2-chloro-5-tetradecanamidophenyl group, a 2-chloro-5-[4-(2,4-di-t-amylphenoxy)butanamido]phenyl group, a 2-chloro-5-[2-(2,4-di-t-amylphenoxy)butanamido]phenyl group, a 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonylphenyl group, a 2,4-dichlorophenyl group, a 2-chloro-5-(1-dodecyloxycarbonylethoxycarbonyl)phenyl group, a 2-chlorophenyl group, and a 2-ethoxyphenyl group.

Examples of $R_{54}$ include a butanoylamino group, a 2-chloro-3-propanoylaminoanilino group, a 3-[2-(2,4-di-t-amylphenoxy)butanamido]benzamide group, a 3-[4-(2,4-di-t-amylphenoxy)butanamido]benzamide group, a 2-chloro-5-tetradecanamidoaniline group, a 5-(2,4-di-t-amylphenoxyacetamido)benzamide group, a 2-chloro-5-dodecenylsuccinimidoanilino group, a 2-chloro-5-[2-(3-t-butyl-4-hydroxyphenoxy)tetradecanamido]anilino group, a 2,2-dimethylpropanamide group, a 2-(3-pentadecylphenoxy)butanamide group, a pyrrolidino group, and an N,N-dibutylamino group.

Preferred examples of $R_{55}$ include a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-t-amylphenoxy)butanamido]phenyl group, and a 2,6-dichloro-4methanesulfonylphenyl group.

Examples of $R_{58}$ include a 2-chlorophenyl group, a pentafluorophenyl group, a heptafluoropropyl group, a 1-(2,4-di-t-amylphenoxy)propyl group, a 3-(2,4-di-t-amylphenoxy)propyl group, a 2,4-di-t-amylmethyl group, and a furyl group.

Examples of $R_{59}$ include a chlorine atom, a methyl group, an ethyl group, a propyl group, a butyl group, an isopropyl group, a 2-(2,4-di-t-amylphenoxy)butanamide group, a 2-(2,4-di-t-amylphenoxy)hexanamide group, a 2-(2,4-di-t-octylphenoxy)octanamide group, a 2-(2-chlorophenoxy)tetradecanamide group, a 2-[4-(4-hydroxyphenylsulfonyl)phenoxy]tetradecanamide group, and a 2-[2-(2,4-di-t-amylphenoxyacetamido)-phenoxy]butanamidea.

Examples of $R_{60}$ include a 4-cyanophenyl group, a 2-cyanophenyl group, a 4-butylsulfonylphenyl group, a 4-propylsulfonylphenyl group, a 4-chloro-3-cyanophenyl group, a 4-ethoxycarbonylphenyl group, and a 3,4-dichlorophenyl group.

Examples of $R_{61}$ include a propyl group, a 2-methoxyphenyl group, a dodecyl group, a hexadecyl group, a cyclohexyl group, a 3-(2,4-di-t-amylphenoxy)propyl group, a 4-(2,4-di-t-amylphenoxy)butyl group, a 3-dodecyloxypropyl group, a t-butyl group, a 2-methoxy-5-dodecyloxycarbonylphenyl group, and a 1-naphthyl group.

Examples of $R_{62}$ include an isobutyloxycarbonylamino group, an ethoxycarbonylamino group, a phenylsulfonylamino group, a methanesulfonamide group, a benzamide group, a trifluoroacetamide group, a 3-phenylureido group, a butoxycarbonylamino group, and an acetamide group.

Examples of $R_{63}$ include a 2,4-di-t-amylphenoxyacetamide group, a 2-(2,4-di-t-amylphenoxy)butanamide group, a hexadecylsulfonamide group, an N-methyl-N-octadecylsulfamoyl group, a 4-t-octylbenzoyl group, a dodecyloxycarbonyl group, a chlorine atom, a nitro group, a cyano group, an N-[4-(2,4-di-t-amylphenoxy)butyl]-carbamoyl group, an N-3-(2,4-di-t-amylphenoxy)propylsulfamoyl group, a methanesulfonyl group, and a hexadecylsulfonyl group.

In general formula (I), preferred examples of the timing groups represented by L include the following groups:

(1) Group utilizing cleavage reaction of hemiacetal

Examples of such a group are those represented by general formula (T-1) as described in U.S. Pat. No. 4,146,396 and JP-A-60-249148 and JP-A-60-249149. In general formula (T-1), the mark * represents the position at which it is connected to A or L in general formula (I) and the mark ** represents the position at which it is connected to L or INH in general formula (I).

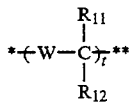

(T-1)

wherein W represents an oxygen atom, a sulfur atom or an

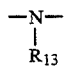

group; $R_{11}$ and $R_{12}$ each represents a hydrogen atom or a substituent; $R_{13}$ represents a substituent; and t represents an integer of 1 or 2. When t is 2, the two

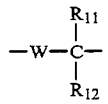

groups may be the same or different. When $R_{11}$ and $R_{12}$ each represents a substituent, typical examples of $R_{11}$, $R_{12}$ and $R_{13}$ include an $R_{15}$ group, an $R_{15}CO$— group, an $R_{15}SO_2$— group an

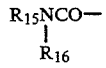

group and an

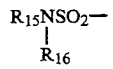

group in which $R_{15}$ represents an aliphatic group (e.g., methyl, ethyl, propyl, butyl, isobutyl, sec-butyl, t-butyl, pentyl, isopropyl, neopentyl), an aromatic group (e.g., phenyl, 1-naphthyl, 2-naphthyl, p-chlorophenyl, o-chlorophenyl, p-nitrophenyl, o-methoxyphenyl, p-methoxyphenyl, p-hydroxyphenyl, p-carboxyphenyl) or a heterocyclic group (e.g., 2-pyridyl, 4-pyridyl, 2-furyl, 1-methyl-4-pyrazolyl, 2-thienyl), and $R_{16}$ represents a hydrogen atom, an aliphatic group (e.g., methyl, ethyl, propyl, butyl, isobutyl, sec-butyl, t-butyl, pentyl, isopropyl, neopentyl), an aromatic group (e.g., phenyl, 1-naphthyl, 2-naphthyl, p-chlorophenyl, o-chlorophenyl, p-nitrophenyl, o-methoxyphenyl, p-methoxyphenyl, p-hydroxyphenyl, p-carboxyphenyl) or a heterocyclic group (e.g., 2-pyridyl, 4-pyridyl, 2-furyl, 1-methyl-4-pyrazolyl, 2-thienyl). $R_{11}$, $R_{12}$ and $R_{13}$ may be divalent groups which are connected to each other to form a cyclic structure. Specific examples of the group represented by general formula (T-1) include those set forth below:

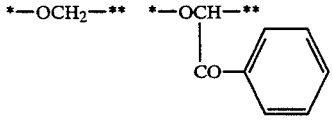

-continued

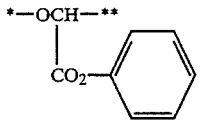

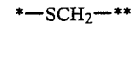

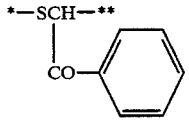

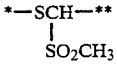

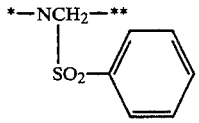

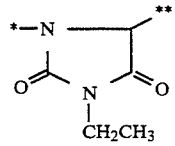

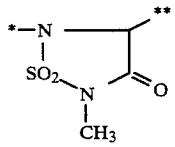

(2) Group which utilizes intramolecular nucleophilic. substitution reaction to initiate cleavage reaction Examples of such a group include timing groups as described in U.S. Pat. No. 4,248,292. Such timing groups can be represented by general formula (T-2):

*—Nu—Link—E—** (T—2)

wherein Nu represents a nucleophilic group with an oxygen atom or a sulfur atom as a nucleophilic seed; E represents an electrophilic group which can undergo nucleophilic attack by Nu to cause cleavage of the bond with **; and Link represents a linking group which makes a three-dimensional relationship between Nu and E so that they can undergo an intramolecular nucleophilic substitution reaction. Specific examples of the group represented by general formula (T-2) include those set forth below:

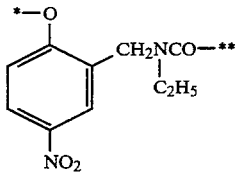

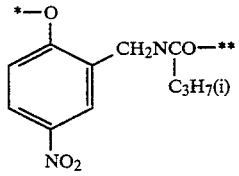

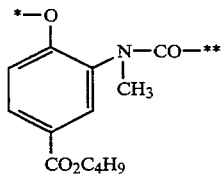

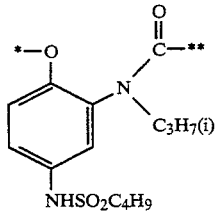

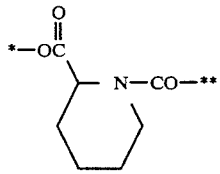

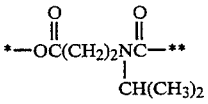

-continued

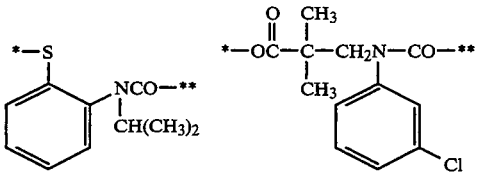

(3) Group which utilizes electron migration reaction along a conjugated system to initiate cleavage reaction Examples of such a group include those described in U.S. Pat. Nos. 4,409,323 and 4,421,845, and JP-A-57-188035, JP-A-58-98728, JP-A-58-209736, JP-A-58-209737 and JP-A-58-209738. Such a group is represented by general formula (T-3):

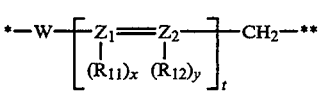

(T-3)

wherein *, **, W, $R_{11}$, $R_{12}$ and t are as defined in general formula (T-1). However, $R_{11}$ and $R_{12}$ may be connected to each other to form a benzene or heterocyclic structural element. Alternatively, $R_{11}$ or $R_{12}$ and W may be connected to each other to form a benzene ring or a heterocyclic group. $Z_1$ and $Z_2$ each independently represents a carbon atom or a nitrogen atom. The suffixes x and y each represents an integer of 0 or 1. When $Z_1$ is a carbon atom, x is 1. When $Z_1$ is a nitrogen atom, x is 0. The relationship between $Z_2$ and y is the same as that between $Z_1$ and x. The suffix t represents an integer of 1 or 2. When t is 2, the two

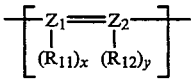

groups may be the same or different

Specific examples of the group represented by general formula (T-3) include those set forth below:

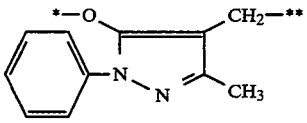

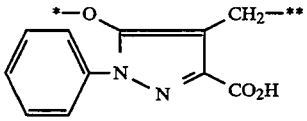

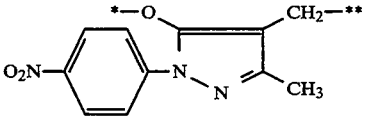

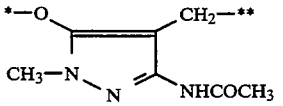

-continued

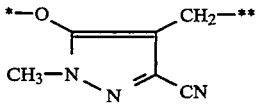

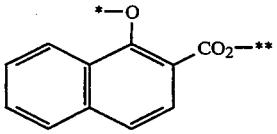

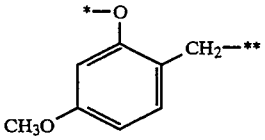

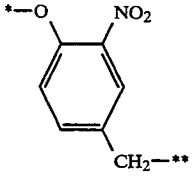

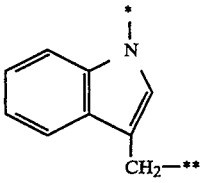

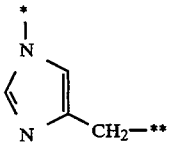

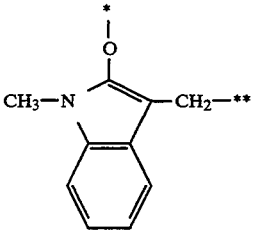

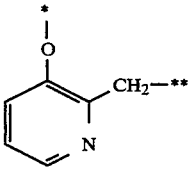

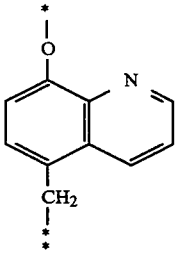

-continued

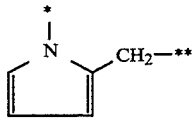

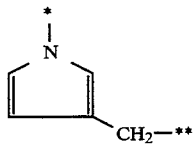

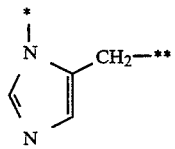

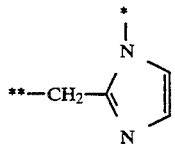

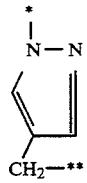

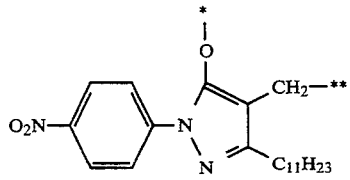

(4) Group which utilizes hydrolysis of ester to initiate cleavage reaction

Examples of such a group include linking groups as described in West German Patent Publication 2,626,315. Specific examples of such linking groups include those set forth below. In the formulae, the marks * and ** are the same meaning as defined in general formula (T-1).

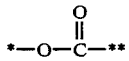

(T-4)

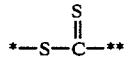

(T-5)

(5) Group which utilizes cleavage reaction of iminoketal

Examples of such a group include linking groups as described in U.S. Pat. No. 4,546,073. Such linking groups are represented by general formula (T-6):

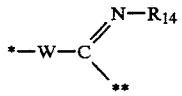

(T-6)

wherein *, ** and W are the same meaning as defined in general formula (T-1); and $R_{14}$ has the same meaning as $R_{13}$ as defined in relation to general formula (T-1). Specific examples of the group represented by general formula (T-6) include those set forth below:

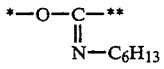

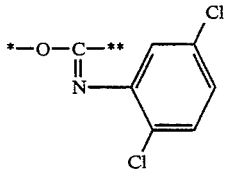

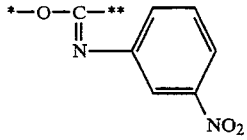

In general formula (I), when L represents a group capable of oxidizing an oxidation product of a developing agent, L is preferably a group represented by general formula (II):

$$*-P-(X=Y)_q-R'-B \qquad \text{(II)}$$

wherein * represents the position at which it is connected to A or L in general formula (I); P and R' each independently represents an oxygen atom or a substituted or unsubstituted imino group; q represents an integer of 1 to 3 (when q is plural, the plurality of X and the plurality of Y may be the same or different); at least one of the plurality of X and Y represents a methine group containing another L group or an —INH—$(CH_2)_n$—Q group as a substituent and the other X and Y pairs each represents a substituted or unsubstituted methine group or a nitrogen atom; and B represents a hydrogen atom or a group capable of being removed by an alkali. Any two substituents selected from P, X, Y and R' may be divalent groups which are connected to each other to form a cyclic structure. Examples of such a cyclic structure include a benzene ring, an imidazole ring and a pyridine ring.

In general formula (II), P preferably represents an oxygen atom and R' preferably represents an oxygen atom or a group represented by any one of the following general formulae:

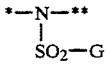

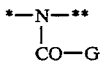

wherein * represents a bond via which it is connected to $(X=Y)_q$; ** represents a bond via which it is connected to B; and G represents a $C_{1-32}$, preferably $C_{1-22}$, straight chain or branched, chain-like or cyclic, saturated or unsaturated, substituted or unsubstituted aliphatic hydrocarbon group (e.g., methyl, ethyl, benzyl, phenoxybutyl and isopropyl), a C6–10 substituted or unsubstituted aromatic group (e.g., phenyl, 4-methylphenyl, 1-naphthyl and 4-dodecyloxylphenyl), a 4- to 7-membered heterocyclic group containing a nitrogen atom, a sulfur atom or an oxygen atom as a hetero atom (e.g., 1-phenyl4-imidazolyl, 2-furyl and benzothienyl) or —O—G' (in which G' has the same meaning as G).

Particularly preferred examples of R' include an oxygen atom and a group represented by general formula:

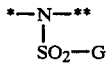

Preferred examples of B, which is a group capable of being removed by an alkali (hereinafter referred to as "precursor group"), include hydrolyzable groups such as acyl, alkoxycarbonyl, aryloxycarbonyl, carbamoyl, imidoyl, oxazolyl and sulfonyl, precursor groups of the type utilizing reverse Michael reaction as described in U.S. Pat. No. 4,009,029, precursor groups of the type utilizing an anion produced after a ring opening cleavage reaction as intramolecular nucleophilic group as described in U.S. Pat. No. 4,310,612, precursor groups which undergo electronic migration of anion along a conjugated system to initiate a cleavage reaction as described in U.S. Pat Nos. 3,674,478, 3,932,480 and 3,993,661, precursor groups which undergo electronic migration of anion resulting from a ring opening reaction to initiate a cleavage reaction as described in U.S. Pat. No. 4,335,200 and precursor groups utilizing an imidomethyl group as described in U.S. Pat Nos. 4,363,865 and 4,410,618.

In general formula (II), P preferably represents an oxygen atom and B preferably represents a hydrogen atom.

In a further preferred case of general formula (II), the other X's and Y's are substituted or unsubstituted methine groups except for the case where X and Y each is a methine group containing another L group or an —INH—$(CH_2)_n$—Q group.

Typical examples of the group represented by general formula (I) will be set forth below. In the following general formulae, * represents the position at which it is connected to A or other L in general formula (I) and ** represents the position at which it is connected to other L or —INH—$(CH_2)_n$—Q.

(R-1)

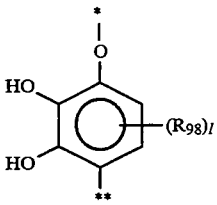

(R-2)

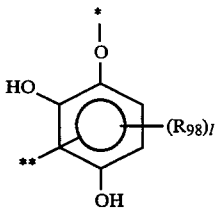

-continued (R-3)

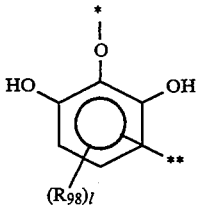

(R-4)

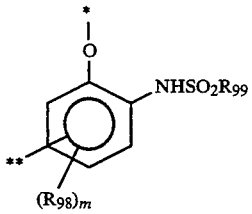

(R-5)

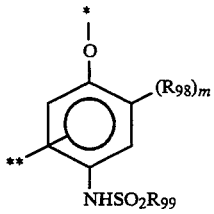

(R-6)

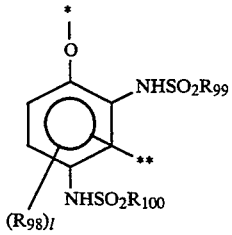

(R-7)

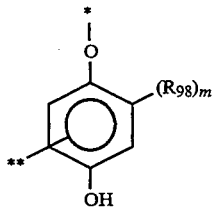

(R-8)

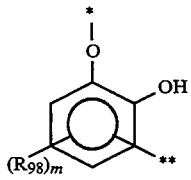

In the above formulae, $R_{98}$ has the same meaning as $R_{63}$ as described before, $R_{99}$ and $R_{100}$ each has the same meaning as $R_{41}$ as described before, l represents an integer of 0 to 2 and m represents an integer of 0 to 3.

In general formula (I), if the group represented by L is a group which undergoes a coupling reaction with an oxidation product of a developing agent to form a substantially colorless compound, examples of such a group include phenolic or naphtholic coupler residues, pyrazolonic coupler residues and indanonic coupler residues. The coupler residues are connected to A or another L via an oxygen atom. After being separated from A or another L, the coupler residues become couplers which then undergo a coupling reaction with a second oxidation product of a second developing agent. Thereupon, a colored dye is normally produced. When the colored dye contains no nondiffusion group and has a properly high diffusibility, it elutes upon development. Therefore, substantially no dyes are left in the light-sensitive material. Even if a diffusible colored dye is produced, it reacts with an alkaline component (e.g., hydroxyl ion and sulfinic acid ion) in the developer upon development to undergo decomposition and decoloration. Therefore, substantially no dyes are left in the light-sensitive material. Preferred examples of the group represented by L include those represented by the following general formulae wherein * represents the position at which it is connected to A or another L, and ** represents the position at which it is connected to another L or —INH—$(CH_2)_n$—Q.

(R-9)

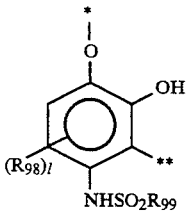

(R-10)

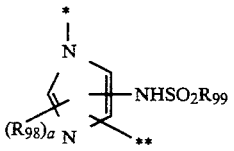

wherein $R_{98}$ has the same meaning as $R_{63}$; $R_{99}$ has the same meaning as $R_{41}$, l represents an integer of 0 to 2; and a represents an integer of 0 or 1.

Specific examples of L which undergoes elimination to form a reducing compound include reducing agents as described in U.S. Pat. Nos.. 4,741,994 and 4,477,560 and JP-A-61-102626, JP-A-61-107245, JP-A-61-113060, JP-A-64-13547, JP-A-64-13548 and JP-A-64-73346.

(R-21)

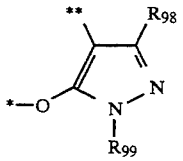

(R-22)

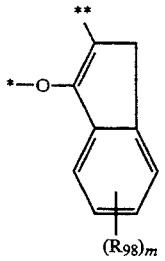

-continued (R-23)

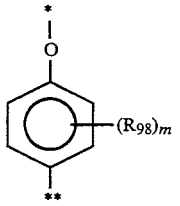

wherein $R_{98}$, $R_{99}$ and m are as defined above for (R-1) to (R-10).

The group represented by general formula (II) is preferably a group which reduces an oxidation product of a developing agent after being separated from A or another L.

At least one of the plurality of L's in the compound represented by general formula (I) is preferably a timing group represented by general formula (T-1) or a reducing agent represented by general formula (II).

The suffix r is preferably 2 or 3, particularly 2.

In the combination of the plurality of L's, adjacent L's are preferably different from each other.

In the compound represented by general formula (I), the group represented by INH is a group which exhibits a development inhibiting effect, preferably a group represented by any one of general formulae (INH-1) to (INH-12). When r is 2 and L which is connected to A is represented by general formula (T-1) or (T-4), another L which is connected to INH excludes the group represented by general formula (T-3).

(INH-1)

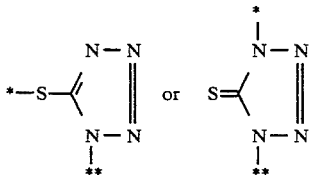

(INH-2)

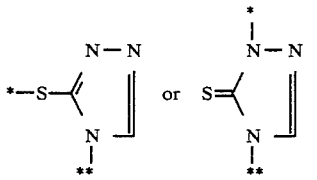

(INH-3)

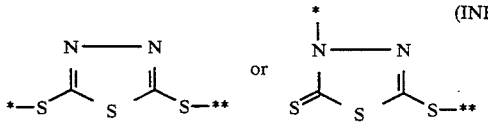

(INH-4)

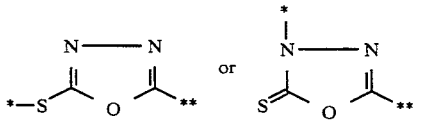

(INH-5)

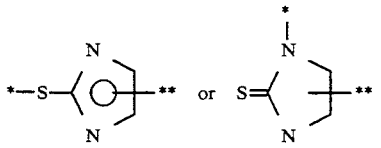

-continued

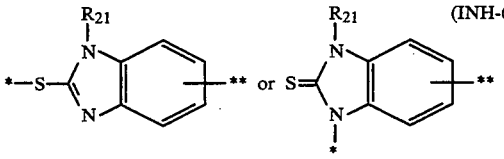

(INH-6)

wherein $R_{21}$ represents a hydrogen atom or a substituted or unsubstituted hydrocarbon group (e.g., methyl, ethyl, propyl and phenyl).

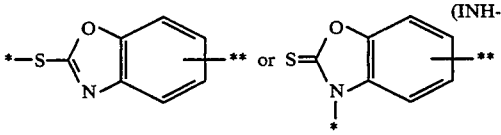

(INH-7)

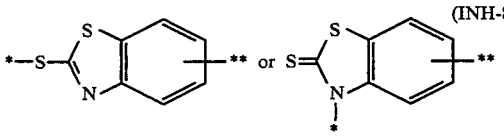

(INH-8)

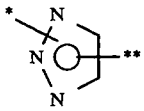

(INH-9)

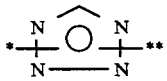

(INH-10)

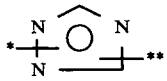

(INH-11)

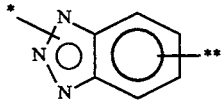

(INH-12)

wherein * represents the position at which INH is connected to L in the compound represented by general formula (I); and ** represents the position at which INH is connected to $-(CH_2)_n-Q$ in the compound represented by general formula (I).

Preferred among the groups are (INH-1), (INH-2), (INH-3), (INH-4) and (INH-12). Particularly preferred among the groups are (INH-1) and (INH-3).

In the compound represented by general formula (I), Q is a group having a molecular weight of 80 to 250, preferably 90 to 200, more preferably 100 to 150. In particular, if n in the compound represented by general formula (I) is 0, Q represents a substituted or unsubstituted 2-branched alkyl group (e.g., 2-hexyl, 2-octyl, toctyl, 2-decyl, 2-dodecyl) or an electron donating group-containing aryl group (e.g., p-methoxyphenyl, p-tolyl). If n is 1 or more, Q represents an alkyl group (e.g., hexyl, octyl, t-octyl, decyl, dodecyl), an acylamino group (e.g., benzamide, hexanamide), an alkoxy group (e.g., octyloxybenzyloxy), a sulfonamide group (e.g., pentanesulfonamide, p-toluenesulfonamide), an aryl group (e.g., p-methoxyphenyl, p-dimethylaminophenyl, p-ethylphenyl), an alkylthio group (e.g., hexylthio, octylthio), an alkylamino group (e.g., dibutylamino, piperidino), an acyloxy group (e.g., butanoyloxy, benzoyloxy), a sulfonyl group (e.g., butanesulfonyl, benzenesulfonyl), an aryloxy group (e.g., phenoxy, p-tolyloxy, p-methoxyphenoxy), a carbamoyl group (e.g., dipropylcarbamoyl, phenylmethylcarbamoyl) or a sulfamoyl group (e.g., dimethylsulfamoyl, diethylsulfamoyl). Q may be further substituted by substitutable groups.

The suffix n is preferably 0 to 2, more preferably 0 or 1. When n is 0, Q is preferably an electron donating group-containing aryl group. When n is 1 or more, Q is preferably an alkoxy group, an aryl group or an aryloxy group. In a particularly preferred case, n is 1 and Q is an aryl group.

specific examples of the compound represented by general formula (I) of the present invention will be set forth below, but the present invention should not be construed as being limited thereto.

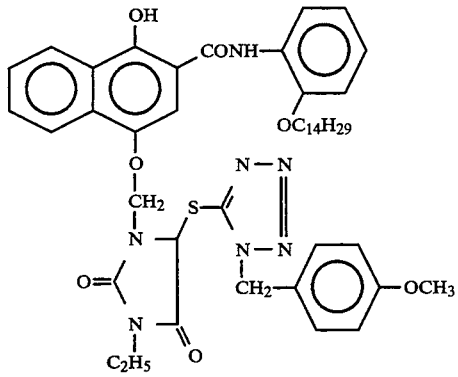

(I)

-continued
(2)
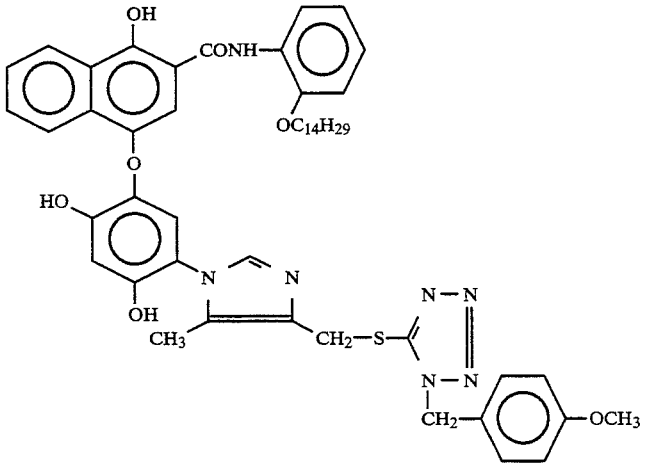
(3)
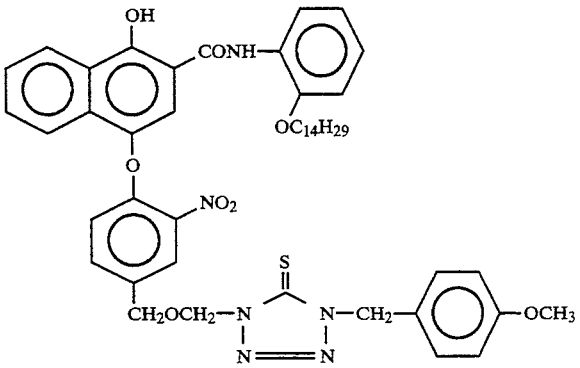
(4)
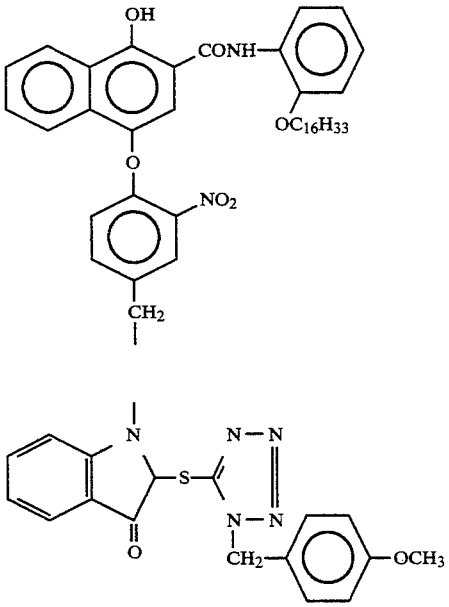

-continued
(5)
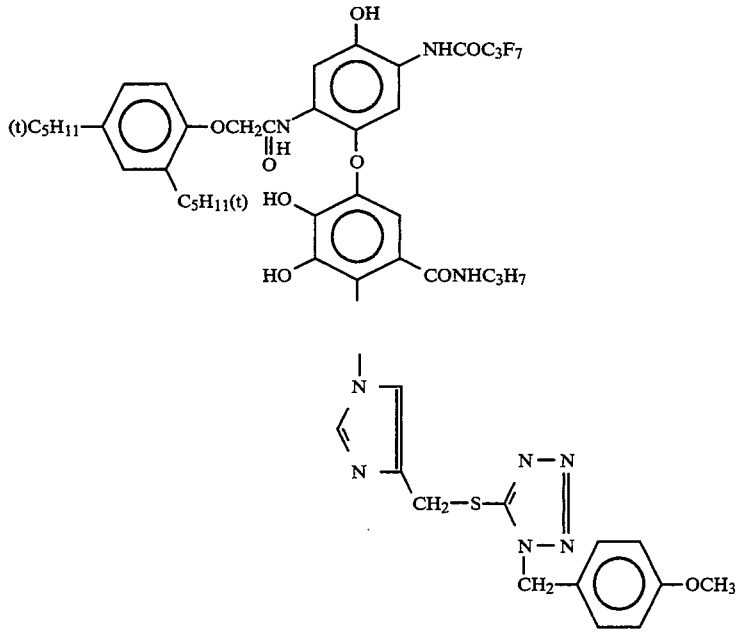
(6)
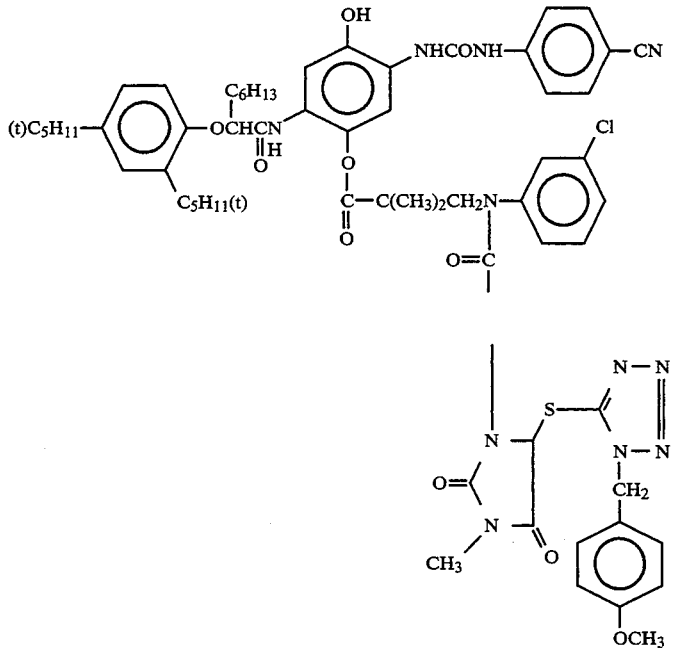
(7)
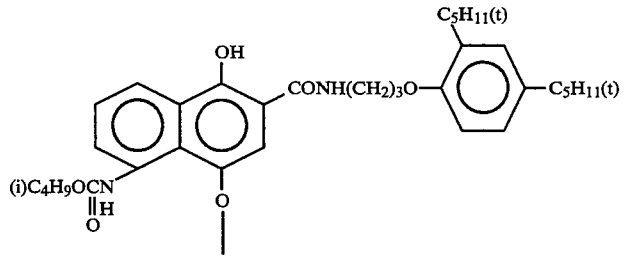

-continued
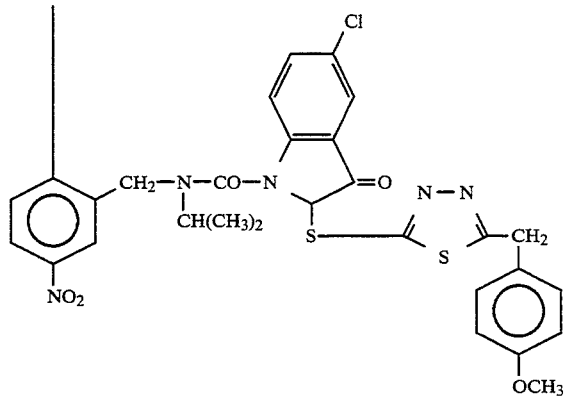
(8)
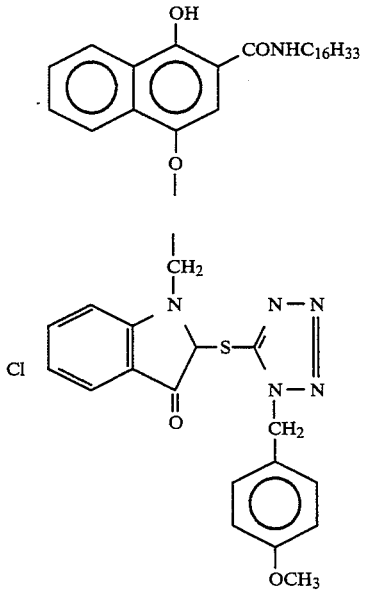
(9)
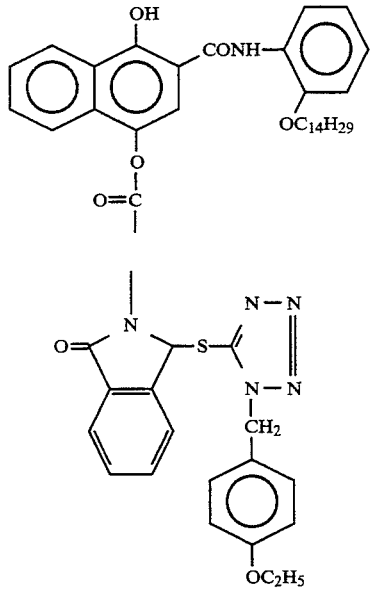

-continued
(10)
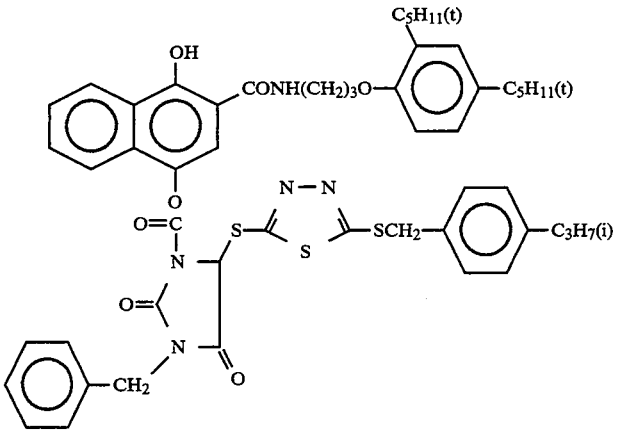
(11)
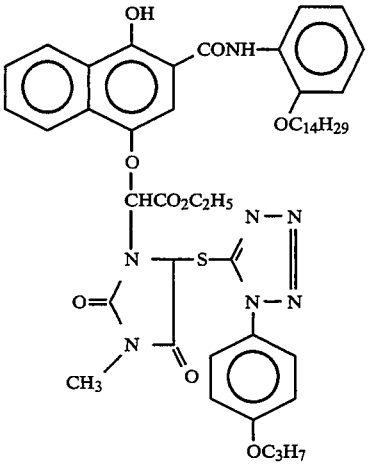
(12)
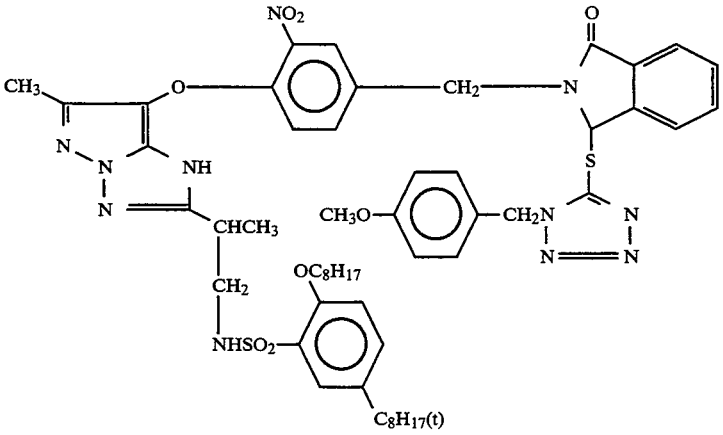

-continued
(13)
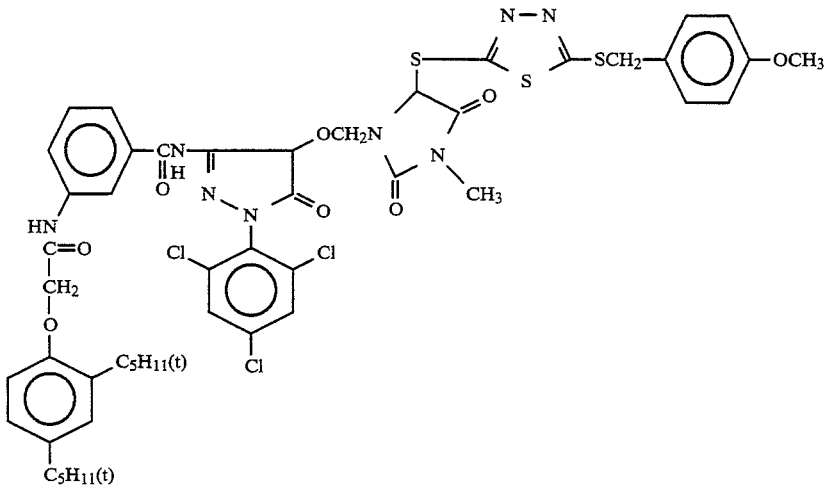
(14)
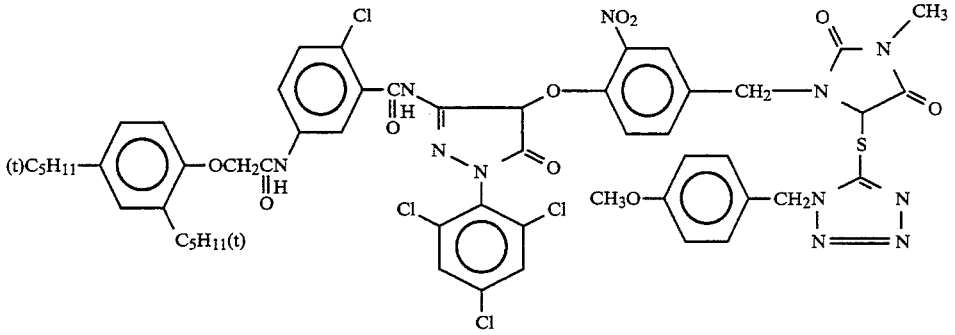
(15)
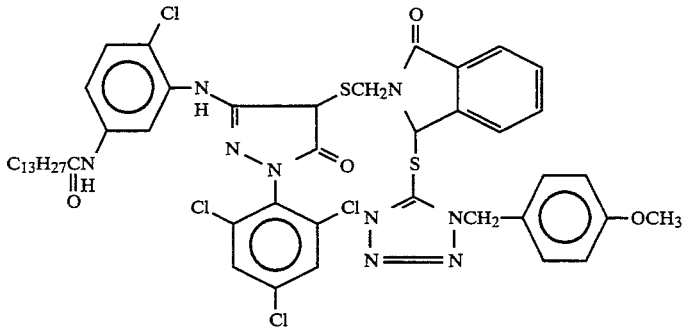
(16)
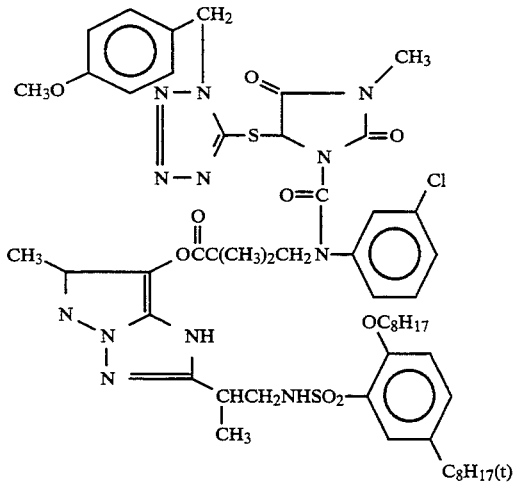

-continued
(17)
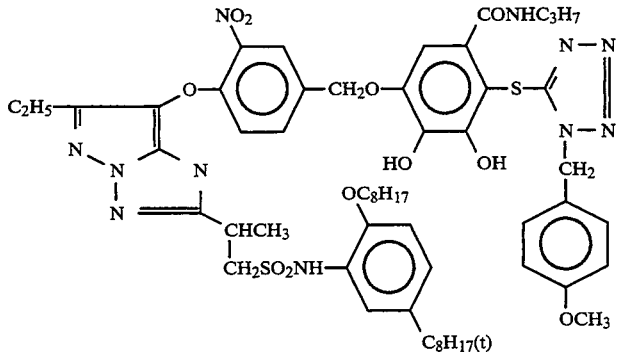
(18)
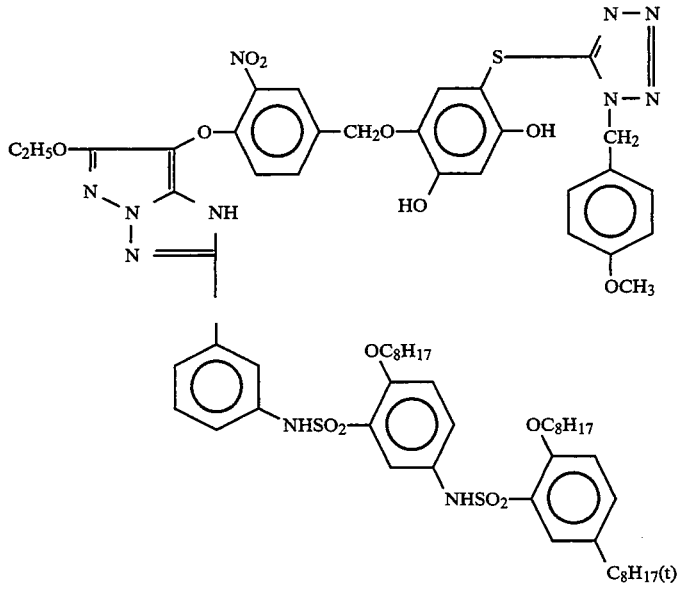
(19)
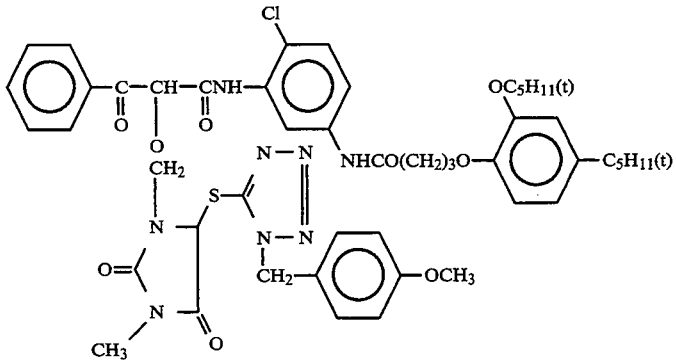
(20)
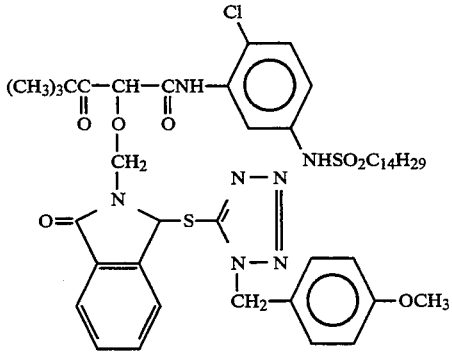

-continued
(21)
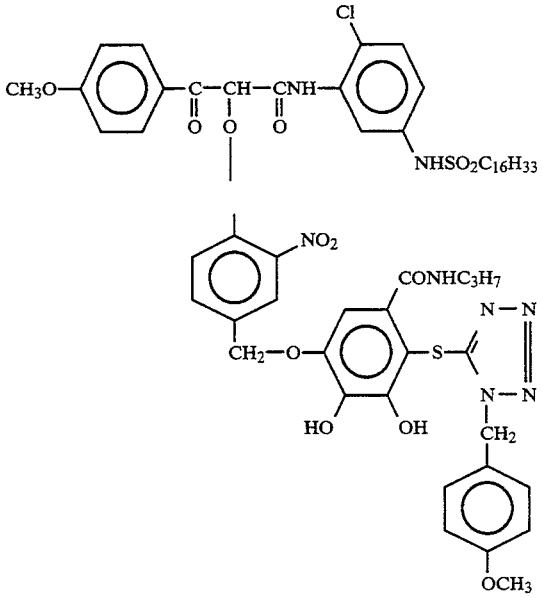
(22)
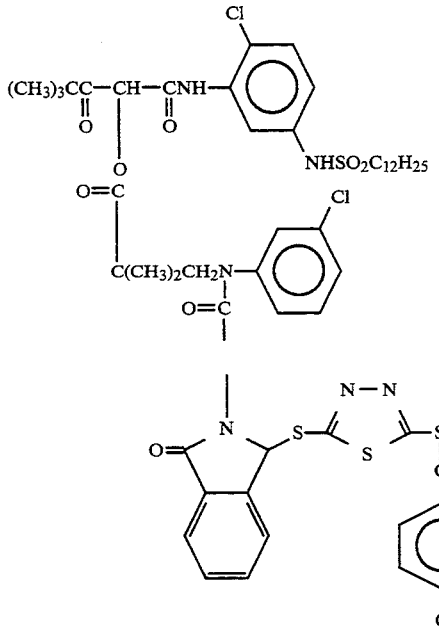
(23)
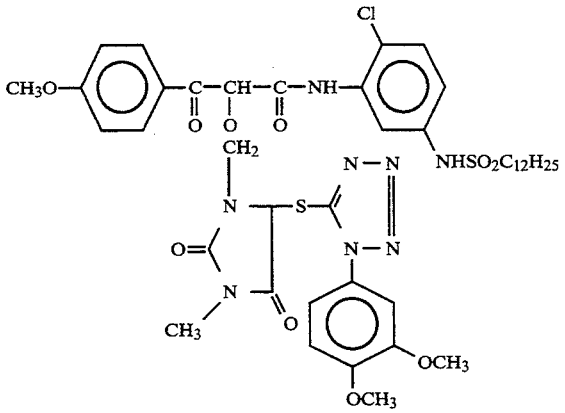

-continued
(24)
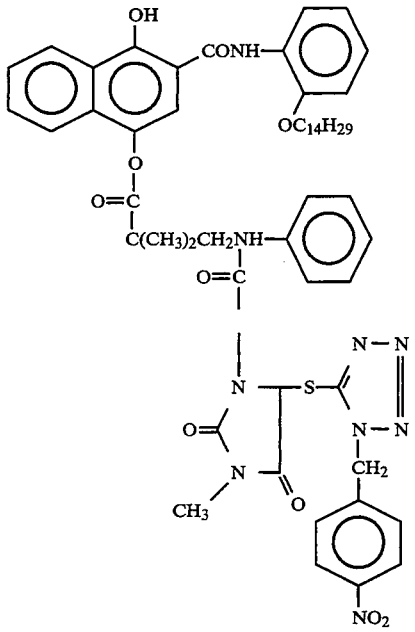
(25)
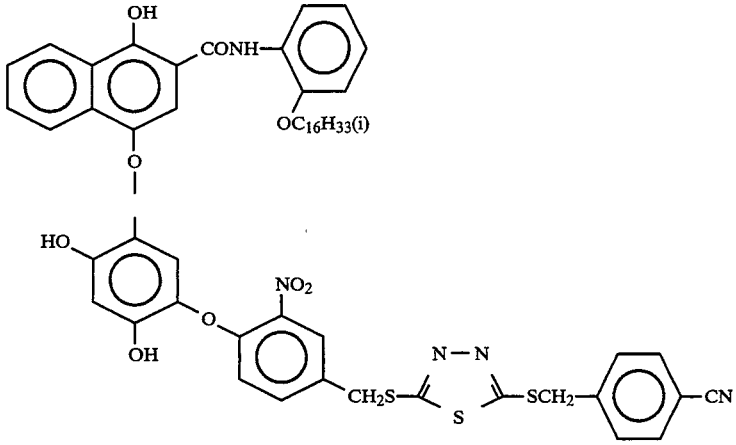
(26)
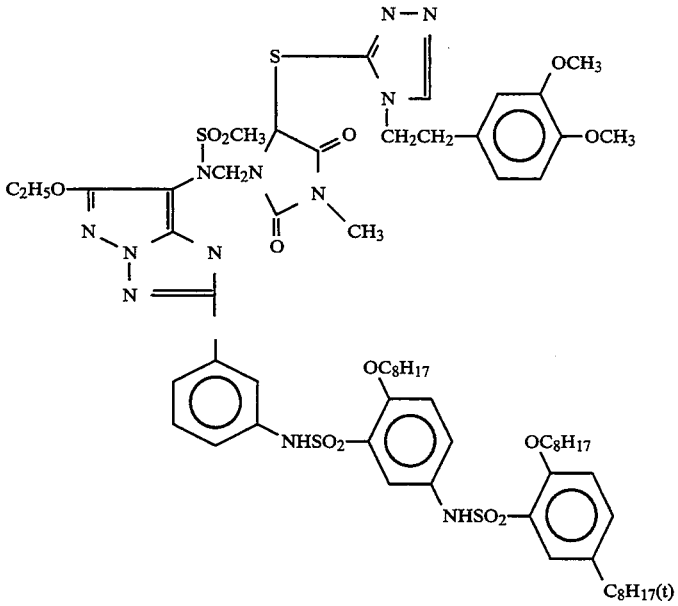

-continued
(27)
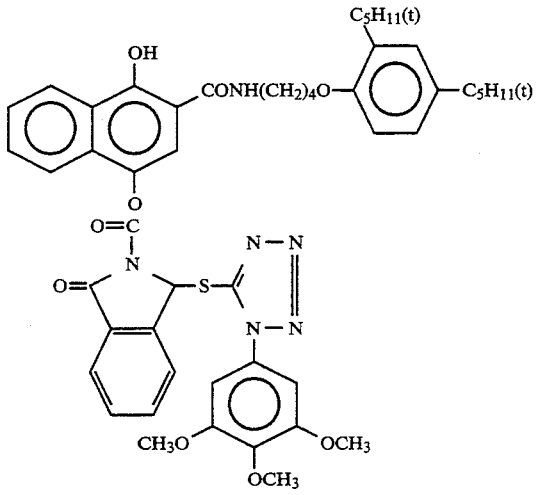
(28)
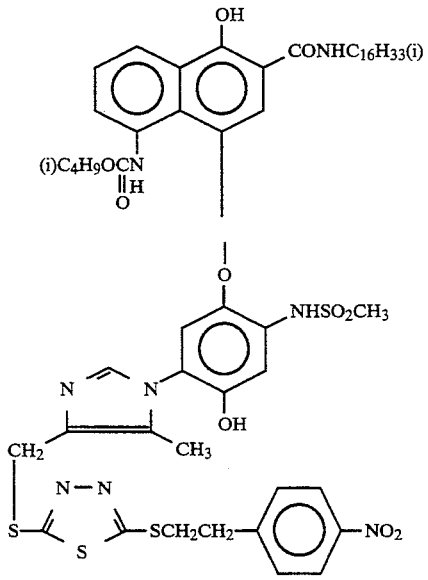
(29)
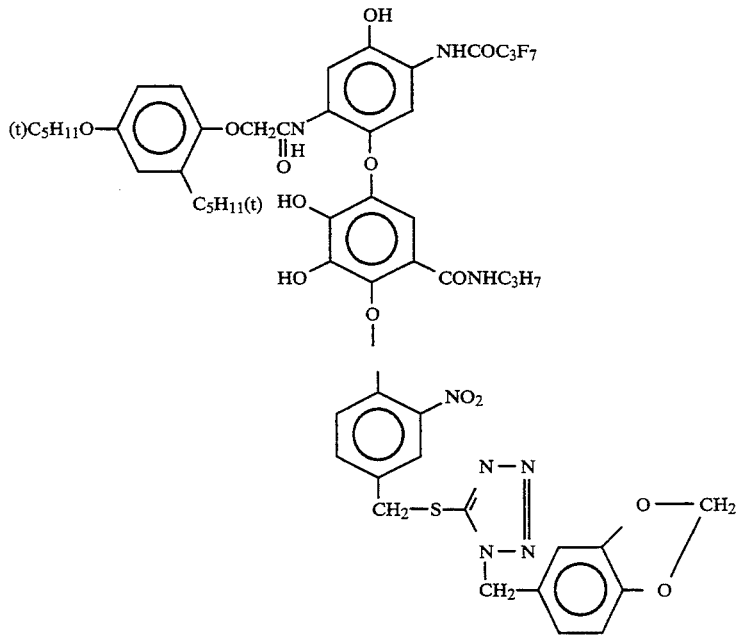

-continued
(30)
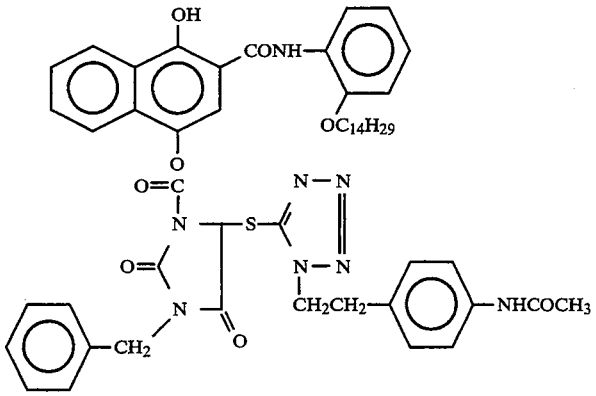
(31)
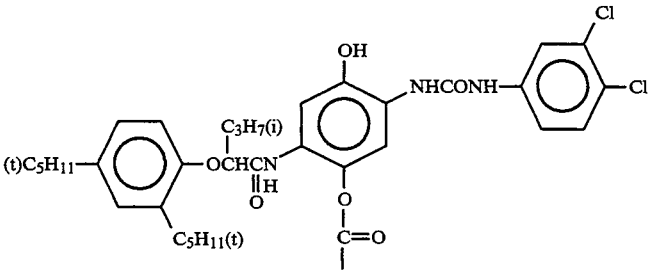
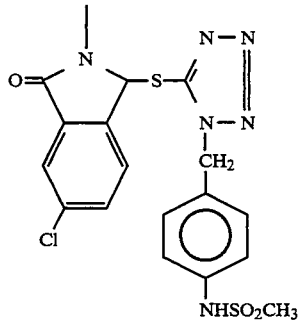
(32)
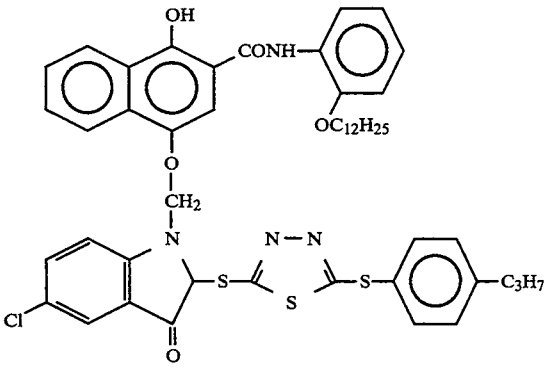

-continued
(33)
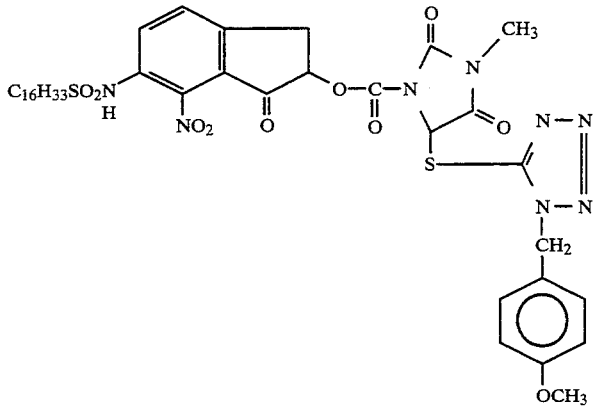
(34)
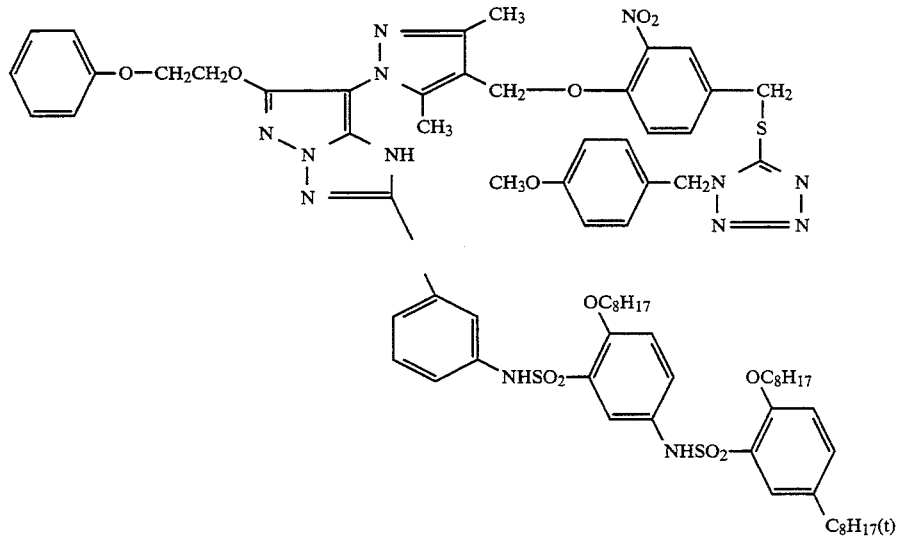
(35)
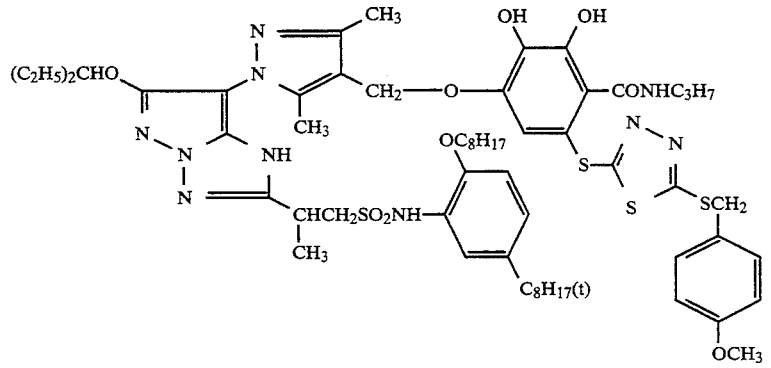
(36)
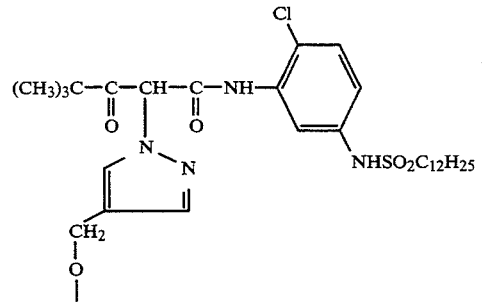

-continued
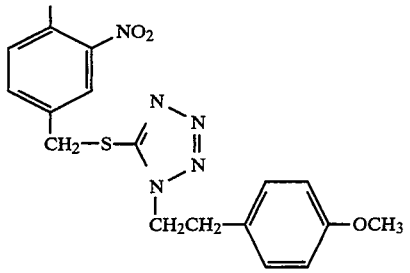
(37)
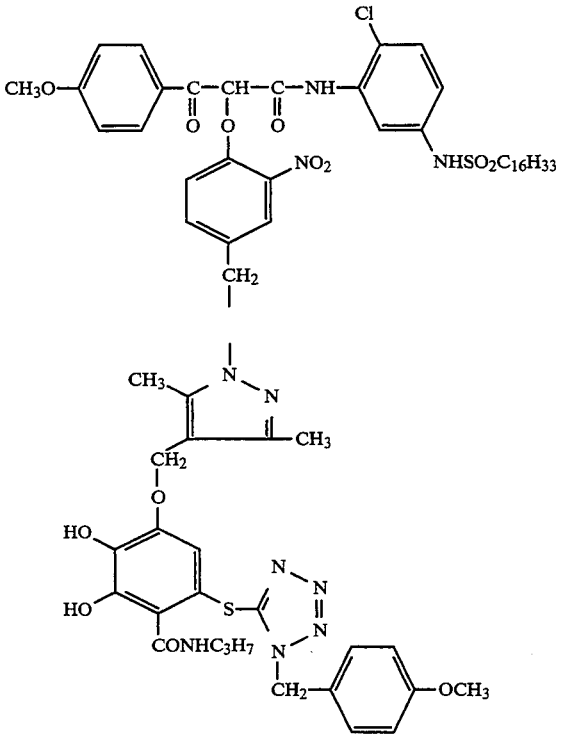
(38)
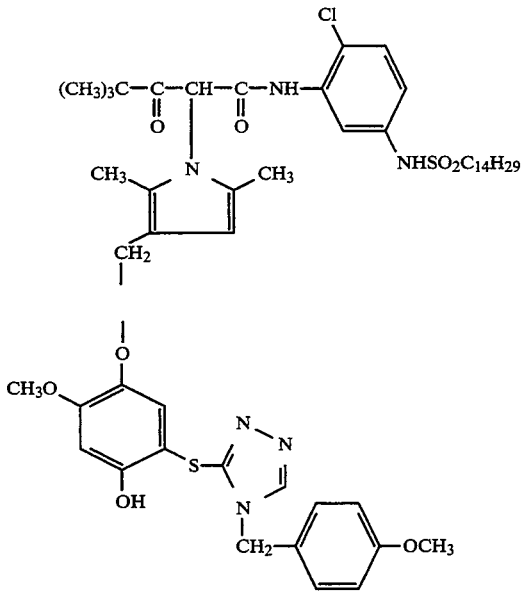

-continued
(39)
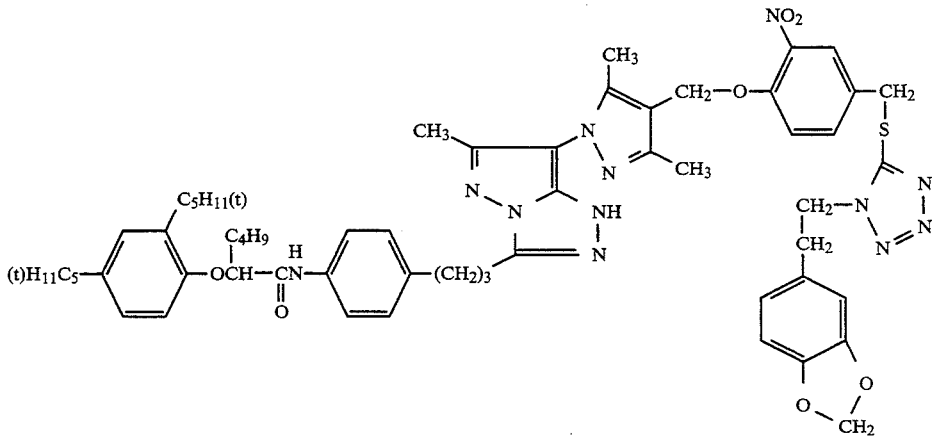
(40)
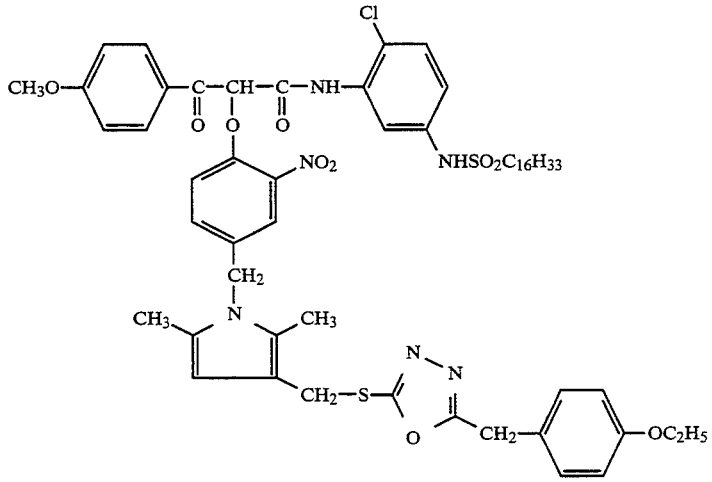
The synthesis of the compound of the present invention can be accomplished by the method disclosed in JP-A-60-218645, JP-A-60-249148, JP-A-61-156127 and JP-A-63-37346. A specific example of the synthesis of Exemplary Compound (3) is set forth below.
SYNTHESIS EXAMPLE 1: Synthesis of Exemplary Compound (3)
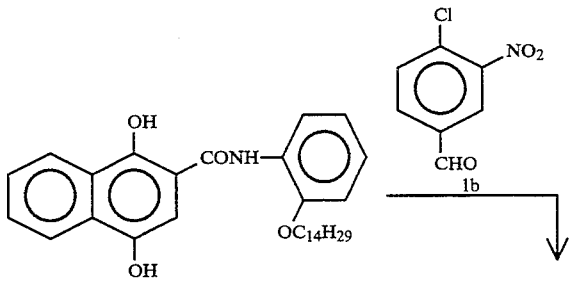

-continued

SYNTHESIS EXAMPLE 1: Synthesis of Exemplary Compound (3)

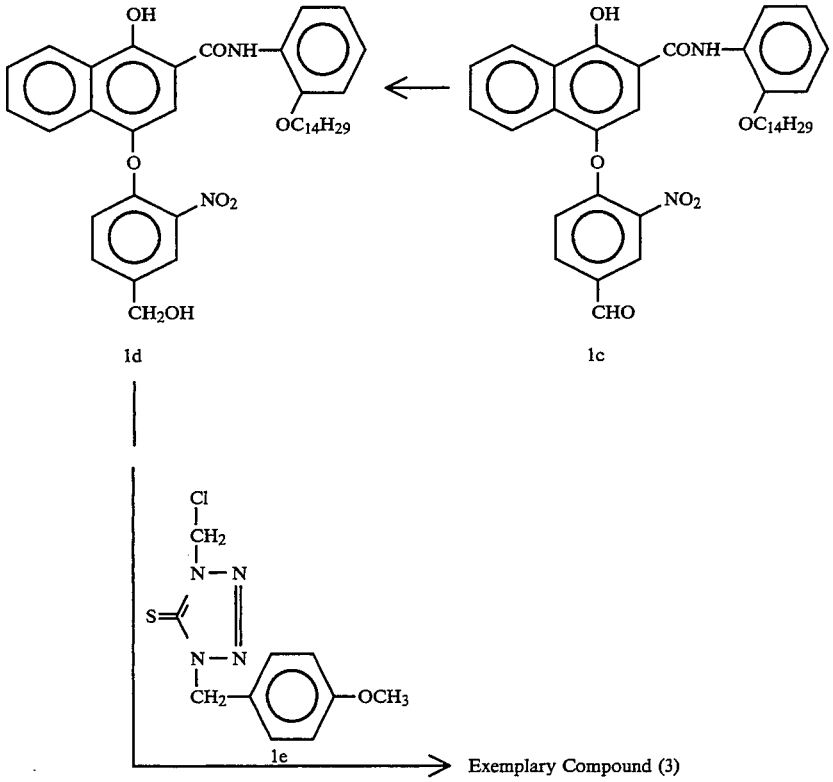

8 g of a 60% oil dispersion of sodium hydride was added to a solution of 49.1 g of Compound 1a in 150 ml of dimethylformamide (DMF). The mixture was then stirred for 10 minutes. 18.6 g of Compound 1b was added to the system. The system was further stirred for 4 hours. 300 ml of 1 N hydrochloric acid and 500 ml of ethyl acetate were added to the system so that an aqueous phase and an organic phase were separated from each other. The organic phase was washed with water, dried with sodium sulfate and then concentrated to obtain Compound 1c as a crude product.

9.5 g of sodium boron hydride was added to a solution of 16 g of Compound 1c in 200 ml of a 9/1 mixture of tetrahydrofuran and methanol. The reaction mixture was allowed to undergo reaction for 3 hours. 1 N hydrochloric acid was added to the system so that the system was acidified. The organic solvent was then distilled off under reduced pressure. The aqueous phase was extracted with chloroform and then concentrated to obtain Compound 1d (m.p. 86° to 91° C.).

8 g of Compound 1d was dissolved in 30 ml of DMF. 1 g of a 60% oil dispersion of sodium hydride was added to the solution. The system was stirred for 10 minutes. 3.4 g of Compound 1e was added to the system. The reaction system was allowed to undergo reaction at room temperature for 3 hours. 1 N hydrochloric acid was added to the system so that the reaction was stopped. Ethyl acetate was added to the system. The resulting organic phase was separated, washed with water twice, dried with sodium sulfate and then concentrated. Mass spectrometry was employed to confirm that Exemplary Compound (3) had been produced ($M^+=876$).

The compounds represented by general formula (I) can be incorporated into any layer in the light-sensitive material, preferably a light-sensitive silver halide emulsion layer and/or its adjacent layers, more preferably a light-sensitive silver halide emulsion layer, particularly preferably a red-sensitive silver halide emulsion layer. The total amount of these compounds to be incorporated in the light-sensitive material is normally from $3\times10^{-7}$ to $1\times10^{-3}$ mol/m$^2$, preferably $3\times10^{-6}$ to $5\times10^{-4}$ mol/m$^2$ more preferably $1\times10^{-5}$ to $2\times10^{-4}$ mol/m$^2$.

The compounds represented by general formula (I) can be incorporated into the light-sensitive material in the same manner as a conventional coupler, as described later.

The color photographic light-sensitive material of the present invention for photographing can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the silver halide photographic material of the present invention comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multilayer silver halide color photographic material, these unit light-sensitive layers are normally arranged in the order of red-sensitive layer, green-sensitive layer and blue-sensitive layer as viewed from the support. However, the order of arrangement can be optionally reversed depending on the application. Alternatively, two unit light-sensitive layers having the same color sensitivity can be arranged with a unit light-sensitive layer having a different color sensitivity interposed between them.

Light-insensitive layers such as various interlayers can be provided between these silver halide light-sensitive layers and on the upper, host layer and lowermost layer of the light-sensitive layers.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor as commonly used.

The plurality of silver halide emulsion layers constituting each unit light-sensitive layer can be preferably a two-layer structure, i.e., a high sensitivity emulsion layer and a low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remotely from the support while a high sensitivity emulsion layer can be provided nearer to the support.

In one embodiment of the present invention, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order from the side farthest from the support. In another embodiment, BH, BL, GL, GH, RH, and RL can be arranged in this order from the side farthest from the support. In a further embodiment, BH, BL, GH, GL, RL, and RH can be arranged in this order from the side farthest from the support.

As described in JP-B-55-34932 (the term "JP-B" as used herein refers to an "examined Japanese patent publication"), a blue-sensitive layer, GH, RH, GL, and RL can be arranged in this order from the side farthest from the support. Alternatively, as described in JP-A-56-25738 and JP-A-62-63936, a blue-sensitive layer, GL, RL, GH, and RH can be arranged in this order from the side farthest from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order from the side farthest from the support in a color-sensitive layer as described in JP-A-59-2024643.

Alternatively, a high sensitivity emulsion layer, a low sensitivity emulsion layer and a middle sensitivity emulsion layer or a low sensitivity emulsion layer, a middle sensitivity emulsion layer and a high sensitivity emulsion layer can be arranged in this order.

In the case where the layer structure comprises four or more layers, the arrangement of the layers can be varied as described above.

In order to improve color reproducibility, a donor layer (CL) having an interimage effect and a different spectral sensitivity distribution from a main light-sensitive layer such as BL, GL and RL may be preferably provided adjacent or close to the main light-sensitive layer.

As described above, various layer structures and arrangements can be selected depending on the purpose of the light-sensitive material.

A suitable silver halide to be incorporated in the photographic emulsion layer in the color light-sensitive material for photographing of the present invention is silver bromoiodide, silver chloroiodide or silver bromochloroiodide containing silver iodide in an amount of about 30 mol % or less. Particularly suitable is silver bromoiodide containing silver iodide in an amount of about 2 mol % to about 25 mol %.

The silver halide grains in the photographic emulsions may be so-called regular grains having a regular crystal form, such as a cube, octahedron and tetradecahedron, or those having an irregular crystal form such as a spherical form or a tabular form, those having a crystal defect such as a twinning plane, or those having a combination of these crystal forms.

The silver halide grains may be either fine grains of about 0.2 μm or smaller in diameter or large grains having a projected area diameter of up to about 10 μm. The emulsion may be either a monodisperse emulsion or a polydisperse emulsion.

The silver halide photographic emulsion which can be used in the present invention can be prepared by any suitable method as described, for example, in *Research Disclosure,* No. 17643 (December, 1978), pages 22 and 23, "I. *Emulsion Preparation and Types*", and No. 18716 (November, 1979), page 648, Glafkides, *Chimie et Physique Photographical,* Paul Montel (1967), G. F. Duffin, *Photographic Emulsion Chemistry,* Focal Press, 1966, and V. L. Zelikman et al., *Making and Coating Photographic Emulsion,* Focal Press, 1964.

Furthermore, monodisperse emulsions as described in U.S. Pat Nos. 3,574,628 and 3,655,394 can be preferably used in the present invention.

Tabular grains having an aspect ratio of about 5 or more can be used in the present invention. The preparation of such tabular grains can be easily accomplished by any suitable method as described, for example, in Gutoff, *Photographic Science and Engineering,* Vol. 14, pages 248 to 257, 1970, U.S. Pat. Nos. 4,434,226, 4,414,310, 4,433,048 and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may be fused to a silver halide having a different halogen composition or a compound other than silver halide, e.g., silver thiocyanate, lead oxide, etc., by an epitaxial junction. Mixtures of grains having various crystal forms may also be used.

The silver halide emulsion to be used in the present invention is normally subjected to physical ripening, chemical ripening and spectral sensitization. Additives to be used in these steps are described, for example, in *Research Disclosure,* Nos. 17643, 18716 and 307105 as tabulated below.

In the present invention, finely divided light-insensitive silver halide grains are preferably used in light-sensitive layers. Finely divided light-insensitive silver halide grains are finely divided silver halide grains which are not sensitive to light upon imagewise exposure for obtaining color images and are not substantially developed. Preferably, the finely divided light-insensitive silver halide grains are not previously fogged.

The finely divided light-insensitive silver halide grains for use in the light-insensitive layers have a silver bromide content of 0 to 100 mol % and may optionally contain silver chloride and/or silver iodide, preferably 0.5 to 10 mol % of silver iodide.

The finely divided light-insensitive silver halide grains in the light-insensitive layers preferably have an average grain diameter of 0.01 to 0.5 μm (as calculated in terms of average of diameters of projected area corresponding to sphere), more preferably 0.02 to 0.2 μm.

The preparation of the finely divided light-insensitive silver halide grains can be accomplished in the same manner as ordinary light-sensitive silver halide grains. In this case, the surface of the silver halide grains does not need to be optically sensitized. Also, the finally divided light-insensitive silver halide grains do not need to be spectrally sensitized. However, before being added to the coating solution, the finally divided light-insensitive silver halide emulsion preferably contains a known stabilizer such as a triazole, azaindene, benzothiazolium or mercapto compound.

Known photographic additives which can be used in the present invention are also described in the above cited three *Research Disclosure* references as shown in the following table.

| Additives | RD 17643 (December, 1978) | RD 18716 (November, 1979) | RD 307105 (November, 1989) |
|---|---|---|---|
| 1. Chemical Sensitizers | Page 23 | Page 648, right column | Page 866 |
| 2. Sensitivity Increasing Agents | — | Page 648, right column | — |
| 3. Spectral Sensitizers and Supersensitizers | Pages 23–24 | Page 648, right column to page 649, right column | Pages 866–868 |
| 4. Brightening Agents | Page 24 | Page 647, right column | Page 868 |
| 5. Antifoggants and Stabilizers | Pages 24–25 | Page 649, right column | Pages 868–870 |
| 6. Light Absorbers, Filter Dyes and Ultraviolet Absorbents | Pages 25–26 | Page 649, right column to page 650, left column | Page 873 |
| 7. Stain Inhibitors | Page 25, right column | Page 650, left to right columns | Page 872 |
| 8. Dye Image Stabilizers | Page 25 | Page 650, left column | Page 872 |
| 9. Hardeners | Page 26 | Page 651, left column | Page 874–875 |
| 10. Binders | Page 26 | Page 651, left column | Pages 873–874 |
| 11. Plasticizers and Lubricants | Page 27 | Page 650, right column | Page 876 |
| 12. Coating Aids and Surface Active Agents | Pages 26–27 | Page 650, right column | Pages 875–876 |
| 13. Antistatic Agents | Page 27 | Page 650, right column | Pages 876–877 |

In order to inhibit deterioration in photographic properties due to formaldehyde gas, a compound capable of reacting with and solidifying formaldehyde as disclosed in U.S. Pat Nos. 4,411,987 and 4,435,503 can be incorporated into the light-sensitive material.

Various color couplers can be used in the present invention. Specific examples of suitable color couplers are disclosed in the patents described in the above cited *Research Disclosure,* No. 17643, VII-C to G and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, JP-A-60-43659, JP-A-61-72238, JP-A-60-35730, JP-A-55-118034, and JP-A-60-185951, *Research Disclosure,* Nos. 24220 (June, 1984) and 24230 (June, 1984), and WO(PCT)88/04795.

Cyan couplers which can be used in the present invention include naphthol and phenol couplers. Preferred are those described in U.S. Pat Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Publication No. 3,329,729, European Patents 121,365A and 249,453A, and JP-A-61-42658.

Typical examples of polymerized dye forming couplers are described in U.S. Pat Nos. 3,451,820, 4,367,282, 4,409,320, and 4,576,910, British Patent 2,102,173, and European Patent 341,188A.

Couplers which form a dye having moderate diffusibility preferably include those described in U.S. Pat No. 4,366,237, British Patent 2,125,570, European Patent 96,570, and West German Patent Publication No. 3,234,533.

Colored couplers for correction of unnecessary absorptions of the developed color preferably include those described in *Research Disclosure,* No. 17643, VII-G, U.S. Pat Nos. 4,163,670, 4,004,929, and 4,138,258, JP-B-57-39413, and British Patent 1,146,368. Furthermore, couplers for correction of unnecessary absorptions of the developed color by a fluorescent dye released upon coupling as described in U.S. Pat. No. 4,774,181 and couplers containing as a separable group a dye precursor group capable of reacting with a developing agent to form a dye as described in U.S. Pat. No. 4,777,120 can be preferably used.

Couplers capable of releasing a photographically useful group upon coupling can also be used in the present invention. Preferred examples of DIR couplers which release a developing inhibitor are described in the patents cited in *Research Disclosure,* No. 17643, VII-F, and No. 307105, VII-F, JP-A-57-151944, JP-A-

57-154234, JP-A-60-184248, and JP-A-63-37346, and U.S. Pat. Nos. 4,248,962 and 4,782,012.

Couplers capable of imagewise releasing a nucleating agent or a developing accelerator at the time of development preferably include those described in British Patents 2,097,140 and 2,131,188, and JP-A-59-157638 and JP-A-59-170840.

In addition to the foregoing couplers, the photographic material according to the present invention can further comprise competing couplers as described in U.S. Pat. No. 4,130,427, polyequivalent couplers as described in U.S. Pat Nos. 4,283,472, 4,338,393, and 4,310,618, DIR redox compounds or DIR couplers or DIR coupler-releasing couplers as described in JP-A-60-185950 and JP-A-62-24252, couplers capable of releasing a dye which returns to its original color after release as described in European Patent 173,302A, couplers capable of releasing a bleach accelerator as described in *Research Disclosure,* Nos. 11449 and 24241, and JP-A-61-201247, couplers capable of releasing a ligand as described in U.S. Pat. No. 4,553,477, couplers capable of releasing a leuco dye as described in JP-A-63-75747, and couplers capable of releasing a fluorescent dye as described in U.S. Pat. No. 4,774,181.

These couplers can be incorporated intp the light-sensitive material by any suitable known dispersion method, such as an oil-in-water dispersion process or a latex dispersion process.

High boiling solvents which can be used in the oil-in-water dispersion process suitable for use with the present invention are described in U.S. Pat. No. 2,322,027.

Specific examples of high boiling organic solvents having a boiling point of 175° C. or higher at normal pressure which can be used in the oil-in-water dispersion process include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azelate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of the latex dispersion method and specific examples of latexes which can be used in the latex dispersion process are described in U.S. Pat. No. 4,199,363, West German Patent Application (OLS) Nos. 2,541,274 and 2,541,230.

Various preservatives or antimolds such as 1,2-benzisothiazoline-3-one, n-butyl, p-hydroxybenzoate, phenol, 4-chloro-3,5-dimethylphenol, 2-phenoxyethanol, and 2-(4-thiazolyl)benzimidazole as described in JP-A-63-257747, JP-A-62-272248 and JP-A-1-80941 may be preferably incorporated into the color light-sensitive material of the present invention.

The present invention is applicable to various types of color light-sensitive materials, preferably to color negative films for ordinary use or motion picture, color reversal films for slide or television, color papers, color positive films and color reversal papers.

Suitable supports which can be used in the present invention are described in the above cited *Research Disclosure,* Nos. 17643 (page 28), 18716 (right column on page 647 to left column on page 648) and 307105 (page 879).

In the light-sensitive material of the present invention, the total thickness of all hydrophilic colloidal layers on the emulsion side is preferably 28 μm or less, more preferably 23 μm or less, furthermore preferably 18 μm or less, particularly preferably 16 μm or less. The film swelling rate $T_{\frac{1}{2}}$ is preferably 30 seconds or less, more preferably 20 seconds or less. The film thickness is determined after being stored at a temperature of 25° C. and a relative humidity of 55% over 2 days. The film swelling rate $T_{\frac{1}{2}}$ can be determined by a method known in the art, e.g., by means of a swellometer of the type as described in A. Green et al., *Photographic Science Engineering,* Vol. 19, No. 2, pages 124 to 129. $T_{\frac{1}{2}}$ is defined as the time taken until half the saturated film thickness is reached, wherein the saturated film thickness is 90% of the maximum swollen film thickness reached when the light-sensitive material is processed with a color developer at a temperature of 30° C. over 195 seconds.

The film swelling rate $T_{\frac{1}{2}}$ can be adjusted by adding a film hardener to a gelatin binder or altering the aging condition after coating. The percentage of swelling of the light-sensitive material is preferably in the range of 150 to 400%. The percentage of swelling can be calculated from the maximum swollen film thickness determined as described above in accordance with the equation: (maximum swollen film thickness—film thickness)/film thickness.

The color photographic light-sensitive material according to the present invention can be developed using conventional methods, such as described in *Research Disclosure,* Nos. 17643 (pages 28 and 29), 18716 (left column to right column on page 615) and 307105 (pages 880 and 881).

The color developer to be used in developing the light-sensitive material of the present invention is preferably an alkaline aqueous solution containing as a main component an aromatic primary amine color developing agent. As the color developing agent, an aminophenolic compound can be effectively used. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these compounds is 3-methyl-4-amino-N-ethyl-N-β-hydroxyethylaniline sulfate. These compounds can be used in a combination of two or more thereof depending on the purpose of application.

The color developer normally contains a pH buffer such as a carbonate and a phosphate of an alkaline metal or a development inhibitor or fog inhibitor such as bromides, iodides, benzimidazoles, benzothiazoles and mercapto compounds. If desired, the color developer may further contain various preservatives, e.g., hydroxylamine, amine, diethylhydroxylamine, sulfites, hydrazines (e.g., N,N-biscarboxymethyl hydrazine), phenylsemicarbazides, triethanolamine, and catechol sulfonic acids; organic solvents, e.g., ethylene glycol and diethylene glycol; development accelerators, e.g., benzyl alcohol, polyethylene glycol, quaternary ammonium salts, and amines; color forming couplers; competing couplers; auxiliary developing agents, e.g., 1-phenyl-3-pyrazolidone; viscosity imparting agents; various chelating agents exemplified by aminopolycarboxylic acids, aminopolyphosphoric acids, alkylphosphonic acids, and phosphonocarboxylic acids, e.g., ethylenediaminetetraacetic acid, nitrilotriacetic acid, diethylenetriaminepentaacetic acid, cyclohexanediaminetetraacetic acid, hydroxyethyliminoacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediaminedi(o-hydroxylphenylacetic acid), and salts thereof.

Reversal processing is usually carried out by black-and-white development followed by color development. Black-and-white developers can contain one or more known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developer usually has a pH of from 9 to 12. The replenishment rate of the developer is usually 3 liters or less per $m^2$ of the light-sensitive material, although the rate depends on the type of color photographic material to be processed. The replenishment rate may be reduced to 500 ml/$m^2$or less by decreasing the bromide ion concentration in the replenisher. When the replenishment rate is reduced, it is preferable to reduce the area of the liquid surface in contact with air in the processing tank to thereby prevent evaporation and air oxidation of the liquid.

The area of the liquid surface in contact with air can be referred to as the opening value defined as follows:

$$\text{Opening Value} = \frac{\text{Area of liquid surface in contact with air (cm}^2\text{)}}{\text{Volume of liquid (cm}^3\text{)}}$$

The opening value is preferably 0.1 or less, more preferably 0.001 to 0.05. The reduction of the opening value can be accomplished by providing a cover such as a floating cover on the surface of the photographic processing solution in the processing tank, or by a process which uses a mobile cover as described in JP-A-1-82033, or a slit development process as described in JP-A-63-216050. The reduction of the opening value can be applied not only to both the color development and black-and-white development but also to the subsequent steps such as bleaching, blixing, fixing, rinsing and stabilizing. The replenishment rate can also be reduced by a means for suppressing the accumulation of bromide ion in the developing solution.

The color development time is normally selected between 2 and 5 minutes. The color development time can be further reduced by carrying out color development at an elevated temperature and a high pH value with a color developing solution containing a high concentration of color developing agent.

The photographic emulsion layer which has been color developed is normally subjected to bleach. Bleaching may be carried out simultaneously with fixing (i.e., blixing), or these two steps may be carried out separately. For speeding up the processing, bleaching may be followed by blixing. Further, other embodiments, such as wherein two blixing baths are connected in series, blixing is preceded by fixing, and blixing is followed by bleaching may be selected according to purpose. Bleaching agents which can be used include compounds of polyvalent metals, e.g., iron(III), peroxides, quinones, and nitro compounds. Typical examples of these bleaching agents are organic complex salts of iron(III) with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid iron(III) complex salts such as (ethylenediaminetetraacetato)iron(III) complex salts are preferred for speeding up processing and preserving the environment. In particular, aminopolycarboxylic acid iron(III) complex salts are useful in both a bleaching solution and a blixing solution. The bleaching or blixing solution containing an aminopolycarboxylic acid iron(III) complex salt normally has a pH value of 4.0 to 8.0. For speeding up processing, it is possible to use a lower pH value.

The bleaching bath, blixing bath or a prebath thereof can contain, if desired, a bleaching accelerator. Examples of useful bleaching accelerators include compounds containing a mercapto group or a disulfide group as described in U.S. Pat. No. 3,893,858, West German Patent 1,290,812, JP-A-53-32736, JP-A-53-57831, JP-A-53- 37418, JP-A-53-72623, JP-A-53-95630, JP-A-53-95631, JP-A-53-104232, JP-A-53-124424, JP-A-53-141623, and JP-A-53-28426, and *Research Disclosure,* No. 17129 (July, 1978), thiazolidine derivatives as described in JP-A-50-140129, thiourea derivatives as described in U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A-49-40943, JP-A-49-59644, JP-A-53-94927, JP-A-54-35727, JP-A-55-26506, and JP-A-58-163940, and bromine ions. Of these compounds, compounds containing a mercapto group or disulfide group are preferred because of their great accelerative effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. The bleaching accelerators may be incorporated into the light-sensitive material. The bleaching accelerators are particularly effective for blixing color light-sensitive photographic materials.

The bleaching solution or blixing solution which can be used in the present invention may preferably contain an organic acid in addition to the above mentioned compounds for the purpose of inhibiting bleach stains. A particularly preferred organic acid is a compound having an acid dissociation constant (pKa) of 2 to 5. Specific examples of such an organic acid include acetic acid and propionic acid.

Fixing agents which can be used in the present invention include thiosulfates, thiocyanates, thioethers, thioureas, and a large amount of iodides. Of the thiosulfates normally used, ammonium thiosulfate has the broadest application. These thiosulfates may preferably be used in combination with thiocyanates, thioether compounds, thiourea or the like. As preservatives for the fixing bath or blixing bath there can be preferably used sulfites, bisulfites, carbonyl bisulfite adducts or sulfinic acid compounds as described in European Patent 294,769A. Further, various aminopolycarboxylic acids or organic phosphonic acids can be added to the fixing bath or blixing bath for the purpose of stabilizing the solution.

In the present invention, the fixing solution or blixing solution preferably contains a compound having a pKa of 6.0 to 9.0, preferably an imidazole, such as, for example, imidazole, 1-methylimidazole, 1-ethylimidazole and 2-methylimidazole, in an amount of 0.1 to 10 mol/liter.

The total desilvering time is preferably short provided that no insufficient desilvering takes place. The total desilvering time is preferably 1 to 3 minutes, more preferably 1 to 2 minutes. The desilvering temperature is usually 25° to 50° C., preferably 35° to 45° C. In this preferred temperature range, the desilvering rate can be improved, and the occurrence of stain after processing can be effectively inhibited.

In the desilvering step, agitation is preferably intensified as much as possible. In particular, agitation can be intensified by various methods. For example, the processing solution may be jetted to the surface of the emulsion layer in the light-sensitive material as described in JP-A-62-183460 and JP-A-62-183461. The agitating effect can be improved by a rotary means as described in JP-A-62-183461. Furthermore, the agitating effect can be improved by moving the light-sensitive material with the emulsion surface in contact with a wiper blade provided in the bath so that a turbulence occurs on the emulsion surface. Moreover, the agitation can be intensified by increasing the total circulated amount of processing solution.

An agitation improving method can be effectively applied to the bleaching bath, blixing bath or fixing bath. The improvement in agitation effect expedites the supply of bleaching agent, fixing agent or the like into the emulsion film, resulting in an improvement in desilvering rate. The above mentioned agitation improving method is more effective when a bleaching accelerator is used. In this case, the agitation improving method can remarkably enhance the bleaching accelerating effect or eliminate the effect of inhibiting fixation by the bleaching accelerator.

An automatic developing machine suitable for use in the present invention is preferably equipped with a light-sensitive material conveying means as described in JP-A-60-191257, JP-A-60-191258 and JP-A-60-191259. As described in the above cited JP-A-60-191257, such a conveying means can remarkably reduce the amount of processing solution carried over from a bath to its succeeding bath, to thereby inhibit the deterioration of properties of the processing solution. Such an effect is particularly effective for reducing the processing time at each step or for reducing the replenishment rate of the processing solution.

It is usual that the thus desilvered silver halide color photographic materials of the present invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., countercurrent flow system or cocurrent flow system), and other various factors. Of these factors, the relationship between the number of washing tanks and the quantity of water in a multistage countercurrent flow system can be obtained according to the method described in *Journal of the Society of Motion Picture and Television Engineer,* vol. 64, pages 248 to 253 (May, 1955).

According to the multistage countercurrent flow system described in the above reference, although the requisite amount of water can be greatly reduced, bacteria would grow due to an increase of the retention time of water in the tank, and floating masses of bacteria would stick to the light-sensitive material. In the present invention, in order to deal with this problem, the method of reducing calcium and magnesium ion concentrations described in JP-A-62-288838 can be used effectively. Further, it is also effective to use isothiazolone compounds or thiabendazoles as described in JP-A-57-8542, chlorine type bactericides, e.g., chlorinated sodium isocyanurate, benzotriazole, and bactericides described in Hiroshi Horiguchi, *Bokin Bobaizai no Kagaku,* Eisei Gijutsu Gakkai (ed.), *Biseibutsu no Mekkin, Sakkin, Bobaigijutsu,* and Nippon Bokin Bobai Gakkai (ed.), *Bokin Bobaizai Jiten* (1986).

The washing water has a pH value of from 4 to 9, preferably from 5 to 8. The temperature of the water and the washing time can be selected from broad ranges depending on the characteristics and end use of the light-sensitive material, but the temperature usually ranges from 15° to 45° C. and developing time from 20 seconds to 10 minutes, preferably from 25° to 40° C. and from 30 seconds to 5 minutes. The light-sensitive material of the present invention may be directly processed with a stabilizer in place of the washing step. For the stabilization, any of the known techniques as described in JP-A-57-8543, JP-A-58-14834 and JP-A-60-220345 can be used.

The aforesaid washing step may be followed by stabilization in some cases. For example, a stabilizing bath containing a dye stabilizer and a surface active agent as is used as a final bath for color light-sensitive materials for photographing. Examples of such a dye stabilizer include aldehydes such as formalin and glutaraldehyde, N-methylol compounds, hexamethylenetetramine, and aldehyde-sulfurous acid adducts.

This stabilizing bath may also contain various chelating agents or bactericides.

The overflow accompanying replenishment of the washing bath and/or stabilizing bath can be reused in other steps such as desilvering.

In processing using an automatic developing machine, if the processing solution is concentrated due to evaporation, water may be preferably supplied to the system to make up for the evaporation.

The silver halide color light-sensitive material of the present invention may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and *Research Disclosure,* Nos. 14850 and 15159, and aldol compounds as described in *Research Disclosure,* No. 13924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A-56-64339, JP-A-57-144547 and JP-A-58-115438.

In the present invention, the various processing solutions are used at a temperature of 10° C. to 50° C. The standard temperature range is normally from 33° C. to 38° C. However, a higher temperature range can be used to accelerate processing to reduce the processing time. On the other hand, a lower temperature range can be used to improve the picture quality or the stability of the processing solutions.

The silver halide photographic material of the present invention can also be applied to a heat-developable light-sensitive material as described in U.S. Pat. No. 4,500,626, JP-A-60-133449, JP-A-59-218443, and JP-A-61-238056, and European Patent 210,660A2.

The present invention will be further described in the following examples, but the present invention should not be construed as being limited thereto.

EXAMPLE 1

A multilayer color light-sensitive material was prepared as Sample 101 by coating on a undercoated cellulose triacetate film support various layers having the following compositions.

Composition of Light-Sensitive Layer

The coated amount of silver halide and colloidal silver is represented in g/m$^2$ as calculated in terms of amount of silver. The coated amount of couplers, additives and gelatin is represented in g/m$^2$. The coated amount of sensitizing dyes is represented in mol per mol of silver halide contained in the same layer.

Sample 101

| | Coated Amount |
|---|---|
| First Layer: Antihalation Layer | |
| Black Colloidal Silver | 0.18 as Ag |
| Gelatin | 0.40 |
| Second Layer: Interlayer | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 0.70 |
| Third Layer: First Red-Sensitive Emulsion Layer | |
| Monodisperse Emulsion of Silver Bromoiodide (silver iodide content: 10 mol %, average grain diameter: 0.50 μm, coefficient of fluctuation in grain diameter: 0.16) | 0.25 as Ag |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.150 |
| EX-10 | 0.020 |
| Compound (1) of the Present Invention | 0.020 |
| Gelatin | 0.45 |
| Fourth Layer: Second Red-Sensitive Emulsion Layer | |
| Emulsion of Tabular Silver Bromoiodide (silver iodide: 4 mol %, average grain diameter: 0.76 μm, average aspect ratio: 7.2, average thickness: 0.18 μm) | 1.0 as Ag |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.012 |
| EX-10 | 0.008 |
| Compound (1) of the Present Invention | 0.015 |
| Gelatin | 0.90 |
| Fifth Layer: Third Red-Sensitive Emulsion Layer | |
| Silver Bromoiodide Emulsion (AgI content: 16 mol %, average grain diameter: 1.1 μm) | 1.60 as Ag |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-10 | 0.003 |
| EX-3 | 0.045 |
| EX-4 | 0.120 |
| Compound (1) of the Present Invention | 0.007 |
| HBS-1 | 0.10 |
| HBS-2 | 0.05 |
| Gelatin | 1.00 |
| Sixth Layer: Interlayer | |
| EX-5 | 0.040 |
| HBS-1 | 0.020 |
| Gelatin | 0.60 |
| Seventh Layer: First Green-Sensitive Emulsion Layer | |
| Emulsion of Tabular Silver Bromoiodide (AgI content: 12 mol %, average grain diameter: 0.6 μm, average aspect ratio: 6.0, average thickness: 0.15) | 0.40 as Ag |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-11 | 0.010 |
| Gelatin | 0.75 |
| Eighth Layer: Second Green-Sensitive Emulsion Layer | |
| Monodisperse Emulsion of Silver Bromoiodide (AgI content: 20 mol %, average grain diameter: 0.7 μm, coefficient of fluctuation in grain diameter: 0.17) | 0.80 as Ag |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-11 | 0.008 |
| Gelatin | 0.90 |
| Ninth Layer: Third Green-Sensitive Emulsion Layer | |
| Silver Bromoiodide Emulsion (AgI content: 14 mol %, average grain diameter: 1.0 μm) | 1.2 as Ag |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| EX-10 | 0.010 |
| Gelatin | 1.00 |
| Tenth Layer: Yellow Filter Layer | |
| Yellow Colloidal Silver | 0.05 as Ag |

-continued

| | Coated Amount |
|---|---|
| EX-5 | 0.08 |
| HBS-1 | 0.03 |
| Gelatin | 0.40 |
| Eleventh Layer: First Blue-Sensitive Emulsion Layer | |
| Emulsion of Tabular Silver Bromoiodide (AgI content: 4 mol %, average grain diameter: 0.6 μm, average aspect ratio: 7.3, average thickness: 0.14) | 0.24 as Ag |
| Sensitizing Dye VIII | $3.5 \times 10^{-4}$ |
| EX-9 | 0.85 |
| EX-8 | 0.059 |
| HBS-1 | 0.28 |
| Gelatin | 1.30 |
| Twelfth Layer: Second Blue-Sensitive Emulsion Layer | |
| Monodisperse Emulsion of Silver Bromoiodide (AgI content: 20 mol %, average grain diameter: 0.8 μm, coefficient of fluctuation in grain diameter: 0.18) | 0.45 as Ag |
| Sensitizing Dye VIII | $2.1 \times 10^{-4}$ |
| EX-9 | 0.20 |
| EX-10 | 0.015 |
| HBS-1 | 0.03 |
| Gelatin | 0.40 |
| Thirteenth Layer: Third Blue-Sensitive Layer | |
| Silver Bromoiodide Emulsion (AgI content: 14 mol %, average grain diameter: 1.3 μm) | 0.77 as Ag |
| Sensitizing Dye VIII | $2.2 \times 10^{-4}$ |
| EX-9 | 0.20 |
| EX-10 | 0.005 |
| HBS-1 | 0.07 |
| Gelatin | 0.55 |
| Fourteenth Layer: First Protective Layer | |
| Silver Bromoiodide Emulsion (AgI content: 2 mol %, average grain diameter: 0.07 μm) | 0.25 as Ag |
| U-4 | 0.11 |
| U-5 | 0.17 |
| HBS-1 | 0.90 |
| Gelatin | 0.60 |
| Fifteenth Layer: Second Protective Layer | |
| Polymethyl Acrylate (diameter: about 1.5 μm) | 0.05 |
| S-1 | 0.05 |
| S-2 | 0.0 |
| Gelatin | 0.60 |

In addition to the above mentioned components, Gelatin Hardener H-1, a surface active agent, benzoisothiazolone (in an average amount of 200 ppm base don gelatin), n-butyl-p-hydroxybenzoate (in an average amount of 500 ppm based on gelatin) and phenoxy ethanol (in an average amount of 1,000 ppm based on gelatin) were incorporated in each of these layers. These 15 layers were then coated simultaneously to a dried film thickness of 17.8 μm.

Samples 102 to 113

Samples 102 to 113 were prepared in the same manner as in Sample 101 except that Compound (1) to be incorporated in the third, fourth and fifth layers was replaced by other compounds of the present invention and comparative compounds. The type and amount of the compounds added are set forth in Table 1. The added amounts were properly adjusted so that the desired gradation (gamma) could be substantially met.

These samples were imagewise exposed to white light, and then subjected to the following color development. The results of the photographic properties are set forth with RMS values (value for cyan image obtained from an aperture with a diameter of 48 μm) indicating the graininess in Table 1. For evaluation of sharpness, these samples were similarly processed, and then subjected to conventional MTF process measurement. Another batch of these samples was similarly exposed, allowed to stand under a forced condition of a temperature of 45° C. and a relative humidity of 80% for 14 days, and then similarly developed. These samples were also irradiated with soft X-ray through an opening having a size of 500 μm×4 cm and an opening having a size of 15 μm×4 cm. For the measurement of edge effect, the cyan density ratio was determined at the center point of each opening.

The development was effected in accordance with the following steps with the following processing solutions by means of an automatic processing machine for motion picture film. For evaluation of photographic properties, samples which had been imagewise exposed to light were processed until the accumulated replenishment of the color developer reached three times the capacity of the mother solution tank.

| Processing Step: Step | Time | Temperature (°C.) | Replenishment Rate* (ml) | Tank Capacity (liter) |
|---|---|---|---|---|
| Color Development | 3 min 15 sec | 38 | 23 | 15 |
| Bleaching | 50 sec | 38 | 5 | 5 |
| Blixing | 50 sec | 38 | — | 5 |
| Fixing | 50 sec | 38 | 16 | 5 |
| Washing (1) | 30 sec | 38 | — | 3 |
| Washing (2) | 20 sec | 38 | 34 | 3 |
| Stabilization | 20 sec | 38 | 20 | 3 |
| Drying | 1 min | 55 | | |

*Determined per 35 mm width and 1 m length.

The washing step was effected in a counter-current process wherein the washing water flows from (2) to (1). The overflow from the washing tanks were all introduced into the fixing bath. In the automatic developing machine, the upper portion of the bleaching bath and the lower portion of the blixing bath, and the upper portion of the fixing bath and the lower portion of the blixing bath were connected to each other via a pipe so that the overflow produced by the supply of the replenisher to the bleaching bath and the fixing bath entirely flowed into the blixing bath. The amount of the developer brought over to the bleaching step, the amount of the bleaching solution brought over to the blixing step, the amount of the blixing solution brought over to the fixing step and the amount of the fixing solution brought over to the washing step were 2.5 ml, 2.0 ml, 2.0 ml and 2.0 ml per m of 35 nun wide light-sensitive material, respectively. The time for crossover was 5 seconds in all the steps. This crossover time is included in the processing time at the previous step. At each processing step, the processing solution was jetted to collide with the emulsion surface of the light-sensitive material by a method as described in JP-A-62-18346.

The various processing solutions had the following compositions:

| | Mother Solution | Replenisher |
|---|---|---|
| Developer: | | |
| Diethylenetriaminepentaacetic Acid | 2.0 g | 2.2 g |
| 1-Hydroxyethylidene-1,1-diphosphonic Acid | 3.3 g | 3.3 g |

-continued

| | Mother Solution | Replenisher |
|---|---|---|
| Sodium Sulfite | 3.9 g | 5.2 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(-β-hydroxyethyl)amino]aniline Sulfate | 4.5 g | 6.1 g |
| Water to make | 1.0 l | 1.0 l |
| pH | 10.05 | 10.15 |
| Bleaching Solution: | | |
| Ferric Ammonium 1,3-Propylenediaminetetraacetate Monohydrate | 144.0 g | 206.0 g |
| Ammonium Bromide | 84.0 g | 120.0 g |
| Ammonium Nitrate | 17.5 g | 25.0 g |
| Hydroxyacetic Acid | 63.0 g | 90.0 g |
| Acetic Acid | 33.2 g | 47.4 g |
| Water to make | 1.0 l | 1.0 l |
| Aqueous Ammonia to make pH | 3.20 | 2.80 |

Blixing Solution

Mother Solution

A 15/85 mixture of the above mentioned mother solution of bleaching solution and the mother solution of the following fixing solution

| Fixing Solution: | Mother Solution | Replenisher |
|---|---|---|
| Ammonium Sulfite | 19.0 g | 57.0 g |
| Aqueous Solution of Ammonium Thiosulfate (700 g/liter) | 280 ml | 840 ml |
| Imidazole | 28.5 g | 85.5 g |
| Ethylenediaminetetraacetic Acid | 12.5 g | 37.5 g |
| Water to make | 1.0 l | 1.0 l |
| Aqueous Ammonia and Acetic Acid to make pH | 7.40 | 7.45 |

-continued

| Fixing Solution: | Mother Solution | Replenisher |
|---|---|---|
| to make pH | | |

Washing Solution

The mother solution was used also as replenisher

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from Rohm & Haas) so that the calcium and magnesium ion concentrations were each reduced to 3 mg/liter or less. Dichlorinated sodium isocyanurate and sodium sulfate were then added to the solution in amounts of 20 mg/liter and 150 mg/liter, respectively. The washing solution thus obtained had a pH value of 6.5 to 7.5.

| Stabilizing Solution: (The mother solution was used also as replenisher) | |
|---|---|
| 37% Formalin | 2.0 ml |
| Polyoxyethylene-p-monononylphenyl Ether (mean polymerization degree: 10) | 0.3 g |
| Disodium Ethylenediaminetetraacetate | 0.05 g |
| Water to make | 1.0 liter |
| pH | 5.0–8.0 |

TABLE 1

| Sample No. | Compound to Be Incorporated in Third, Fourth and Fifth Layers: Type | Amount* | RMS × 1,000 (at cyan density of 0.5) | MTF Cyan Image (25 cycle/mm) | Edge Effect | After 45° C., 80% RH 14 Day Storage: Fog Change | Sensitivity Change |
|---|---|---|---|---|---|---|---|
| 101 (Invention) | (1) | 1.0 | 32.5 | 0.67 | 1.54 | +0.02 | −0.06 |
| 102 (Invention) | (2) | 1.5 | 33.1 | 0.65 | 1.51 | +0.02 | −0.05 |
| 103 (Invention) | (3) | 2.0 | 32.4 | 0.67 | 1.54 | +0.02 | −0.05 |
| 104 (Invention) | (5) | 3.0 | 32.8 | 0.66 | 1.53 | +0.03 | −0.07 |
| 105 (Invention) | (10) | 1.5 | 33.0 | 0.67 | 1.54 | +0.03 | −0.07 |
| 106 (Invention) | (11) | 1.5 | 33.1 | 0.66 | 1.53 | +0.03 | −0.06 |
| 107 (Comparison) | C-1 | 8.0 | 37.2 | 0.62 | 1.37 | +0.06 | −0.11 |
| 108 (Comparison) | C-2 | 5.0 | 36.9 | 0.61 | 1.36 | +0.05 | −0.12 |
| 109 (Comparison) | C-3 | 4.0 | 35.7 | 0.61 | 1.36 | +0.07 | −0.14 |
| 110 (Comparison) | C-4 | 5.0 | 36.3 | 0.63 | 1.38 | +0.05 | −0.12 |
| 111 (Comparison) | C-5 | 2.5 | 34.4 | 0.58 | 1.33 | +0.05 | −0.12 |
| 112 (Comparison) | C-6 | 3.5 | 35.0 | 0.60 | 1.41 | +0.07 | −0.14 |
| 113 (Comparison) | C-7 | 0.6 | 33.9 | 0.62 | 1.48 | +0.04 | −0.14 |

*Molar ratio relative to that of Compound (1) in Sample 1 as 1.0.

It is obvious from Table 1 that the samples of the present invention exhibit an excellent sharpness represented by MTF value and edge effect, an excellent graininess represented by RMS value and a small change in photographic properties under a condition of 45° C. and 80% RH while keeping the change in color stain small.

EXAMPLE 2

A sample was prepared by incorporating the present Compounds (3), (4) and (6) and Comparative Compounds C-2 and C-4 in the fourth layer in Sample 101 in JP-A-1-243056 in amounts of $7\times10^{-5}$ mol/m$^2$, respectively. This sample was then edgewise exposed to light in the same manner as in Example 1 and subjected to the following color development. The results are set forth in Table 2.

Table 2 shows the effectiveness of the present invention.

The color development was effected at a temperature of 38° C. by means of an automatic developing machine as follows:

| | |
|---|---|
| Color Development | 3 min 15 sec |
| Bleaching | 1 min |
| Blixing | 3 min 15 sec |
| Washing (1) | 40 sec |
| Washing (2) | 1 min |
| Stabilization | 40 sec |
| Drying (50° C.) | 1 min 15 sec |

The washing step was effected in a countercurrent process wherein the washing water flows from (2) to (1). The composition of the various processing solutions will be further described hereinafter.

The replenishment rate of the color developer was 1,200 ml per m$^2$ of color light-sensitive material. The replenishment rate of the other processing solutions were each 800 ml per m$^2$ of color light-sensitive material. The amount of the processing solution brought over into the washing step from the prebath was 50 ml per m$^2$ of color light-sensitive material.

The various processing solutions had the following compositions:

| Color Developer: | Mother Solution | Replenisher |
|---|---|---|
| Diethylenetriaminepentaacetic Acid | 1.0 g | 1.1 g |
| 1-Hydroxyethylidene-1,1-diphosphonic Acid | 2.0 g | 2.2 g |
| Sodium Sulfite | 4.0 g | 4.4 g |
| Potassium Carbonate | 30.0 g | 32.0 g |
| Potassium Bromide | 1.4 g | 0.7 g |
| Potassium Iodide | 1.3 mg | — |
| Hydroxylamine Sulfate | 2.4 g | 2.6 g |
| 4-(N-Ethyl-N-β-hydroxyethylamino)-2-methylaniline Sulfate | 4.5 g | 5.0 g |
| Water to make | 1.0 l | 1.0 l |
| pH | 10.0 | 10.05 |

Bleaching Solution

The mother solution was used also as replenisher.

| | |
|---|---|
| Ferric Ammonium Ethylenediaminetetraacetate | 120.0 g |
| Disodium Ethylenediaminetetraacetate | 10.0 g |

-continued

| | |
|---|---|
| Ammonium Nitrate | 10.0 g |
| Ammonium Bromide | 100.0 g |
| Bleaching Accelerator | $5\times10^{-3}$ mol |

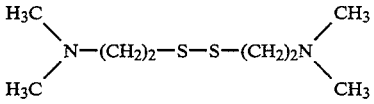

| | |
|---|---|
| Aqueous Ammonia to make | pH 6.3 |
| Water to make | 1.0 liter |

| | |
|---|---|
| Ferric Ammonium Ethylenediaminetetraacetate | 50.0 g |
| Disodium Ethylenediaminetetraacetate | 5.0 g |
| Sodium Sulfite | 12.0 g |
| Aqueous Solution of Ammonium Thiosulfate (70%) | 240 ml |
| Aqueous Ammonia to make | pH 7.3 |
| Water to make | 1 liter |

Blixing Solution

The mother solution was used also as replenisher

Washing Solution

Tap water containing 32 mg/liter of calcium ion and 7.3 mg/liter of magnesium ion was passed through a column packed with an H-type strongly acidic cation exchange resin and an OH-type strongly basic anion exchange resin so that the calcium ion concentration and magnesium ion concentration were reduced down to 1.2 mg/liter and 0.4 mg/liter, respectively. Dichlorinated sodium isocyanurate was added to the solution in an amount of 20 mg/liter.

Stabilizing Solution

The mother solution was used also as replenished

| | |
|---|---|
| 37% W/V Formalin | 2.0 ml |
| Polyoxyethylene-p-monononylphenyl Ether (mean polymerization degree: 10) | 0.3 g |
| Disodium Ethylenediaminetetraacetate | 0.05 g |
| Water to make | 1 liter |
| pH | 5.8 |

Drying

The drying temperature was 50° C.

TABLE 2

| Sample No. | Compound Incorporated in Fourth Layer | Edge Effect |
|---|---|---|
| 201 (Invention) | (3) | 1.63 |
| 202 (Invention) | (4) | 1.60 |
| 203 (Invention) | (6) | 1.62 |
| 204 (Comparison) | C-2 | 1.45 |
| 205 (Comparison) | C-4 | 1.47 |

Compounds Used in the Examples

-continued
U-1
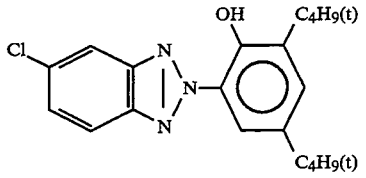
U-2
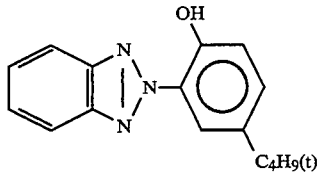
U-3
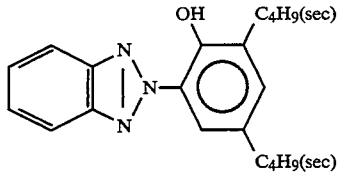
U-4
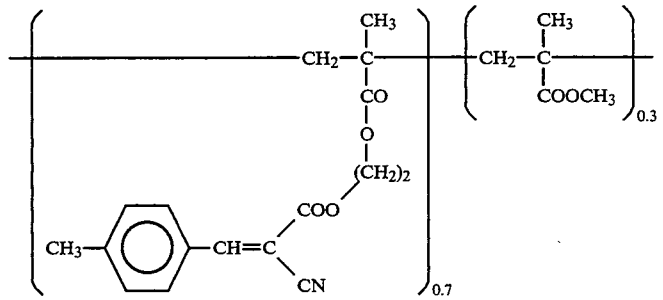
U-5
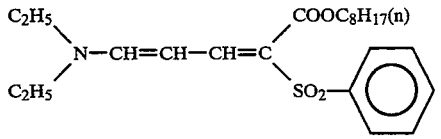
EX-1
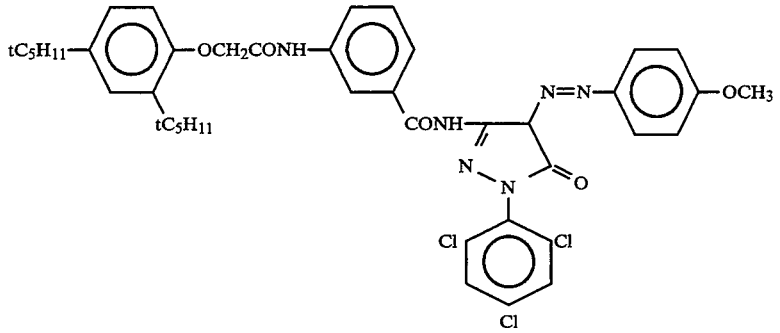
EX-2
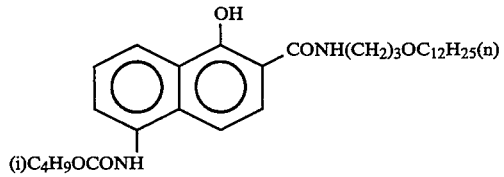

-continued
EX-3
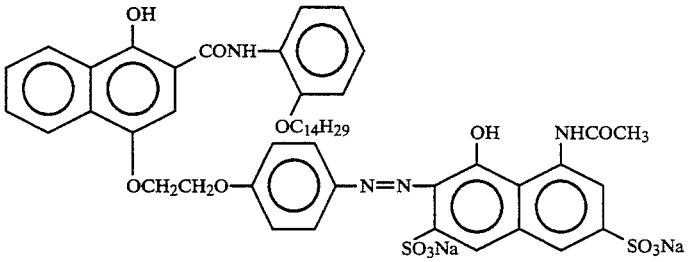
EX-4
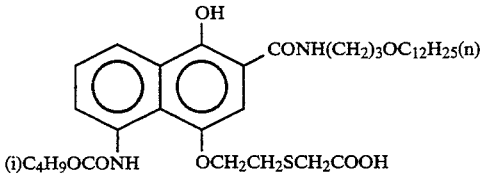
EX-5
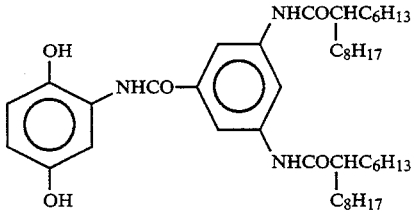
EX-6
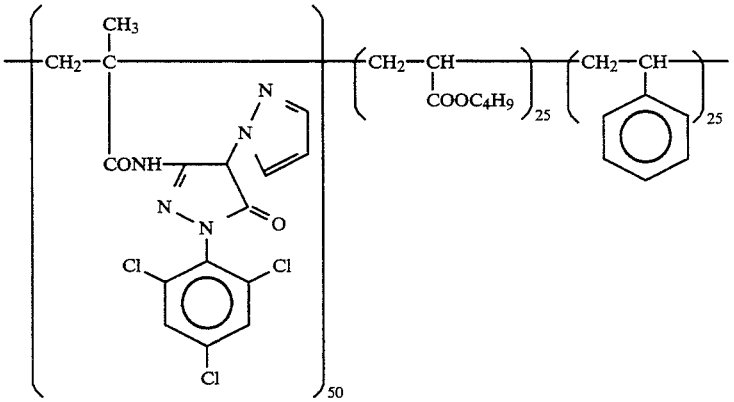
Average molecular weight: 30,000
EX-7
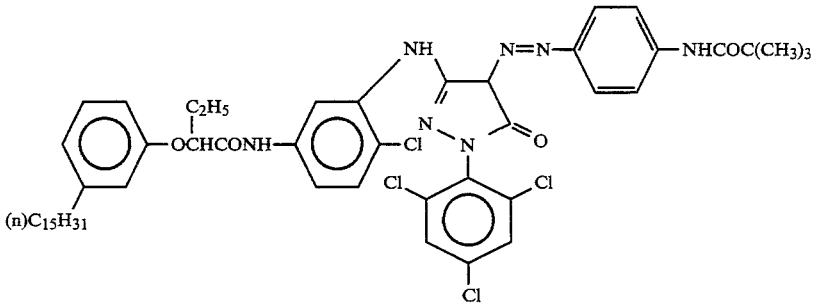

-continued
EX-8
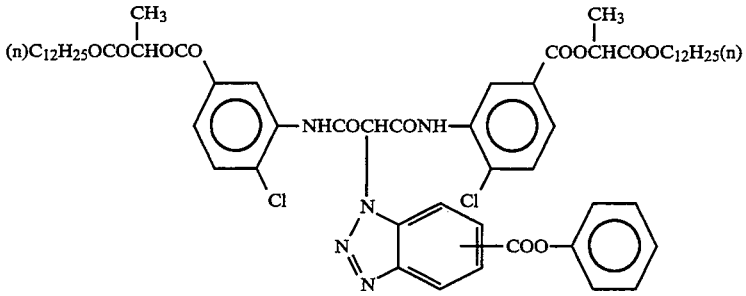
EX-9
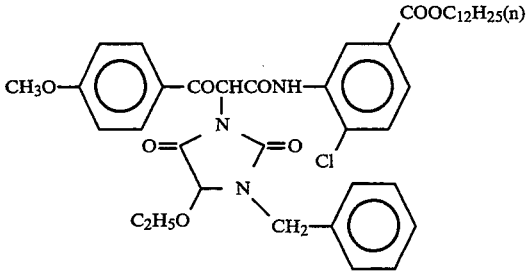
EX-10
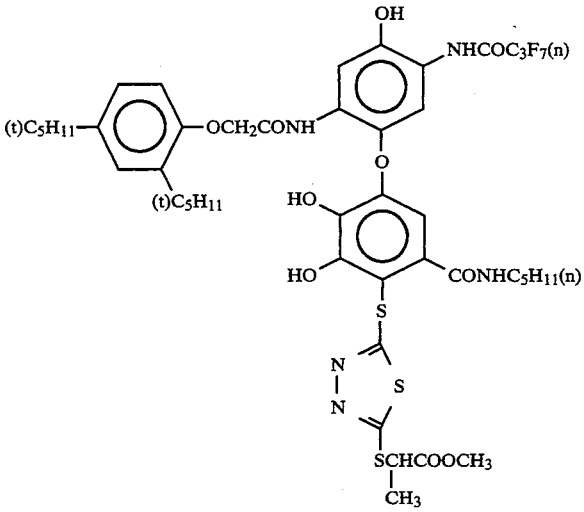
EX-11
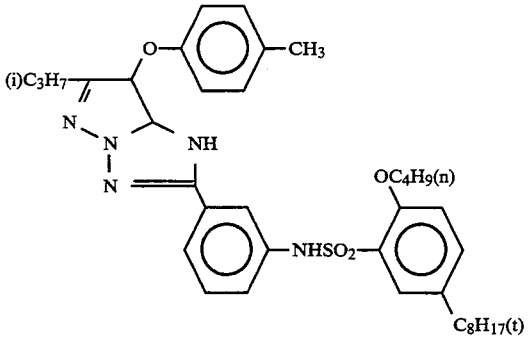
EX-12
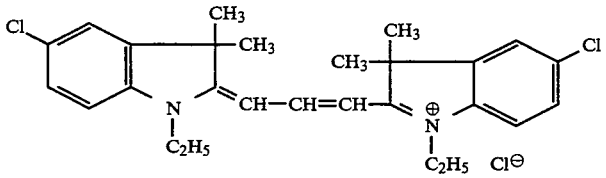

-continued
S-1
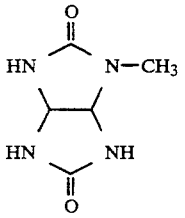
S-2
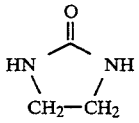
Tricresyl phosphate HBS-1
Dibutyl phthalate HBS-2
HBS-11
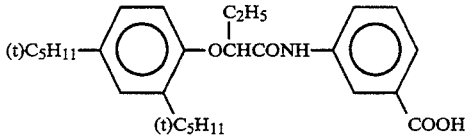
H-1
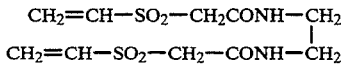
Sensitizing Dyes
I
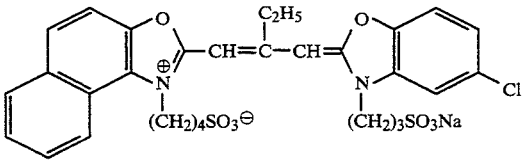
II
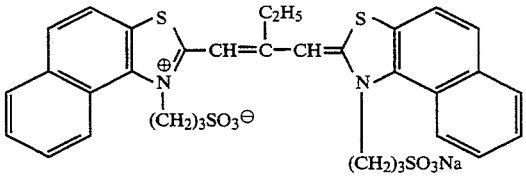
III
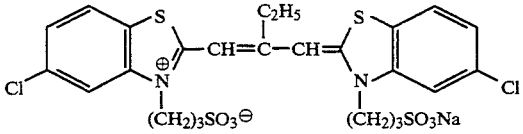
IV
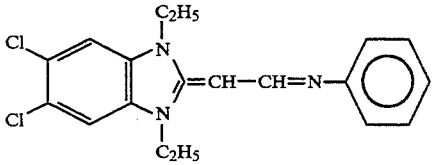
V
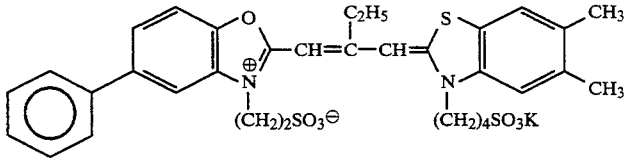

-continued
VI
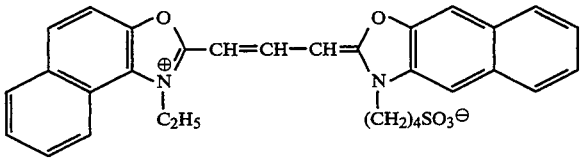
VII
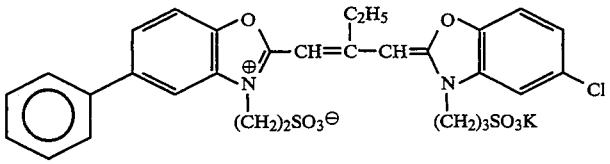
VIII
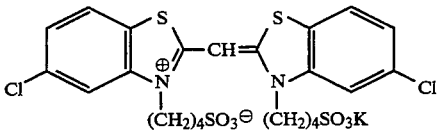
IX
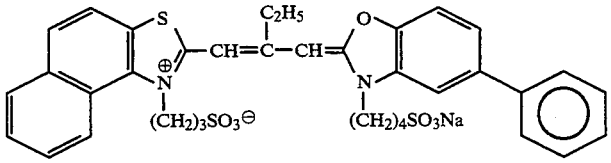
C-1
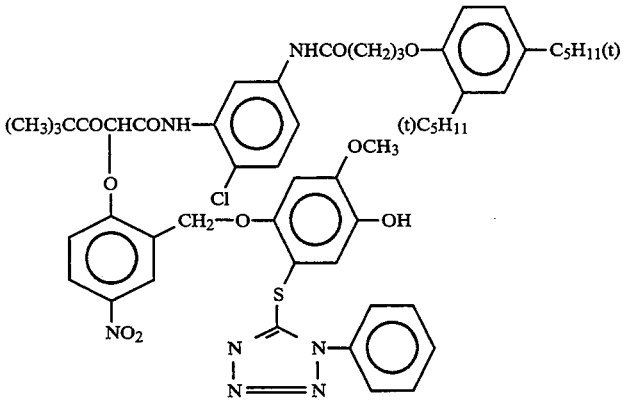
(Coupler (17) as disclosed in JP-A-61-231553)
C-2
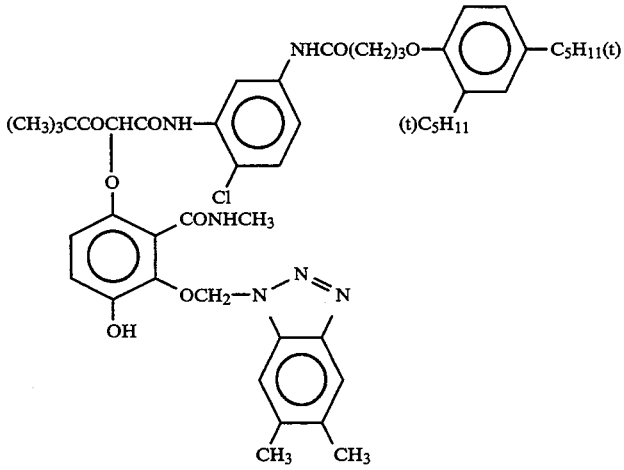
(Coupler (1) as disclosed in JP-A-61-240240)

-continued
C-3
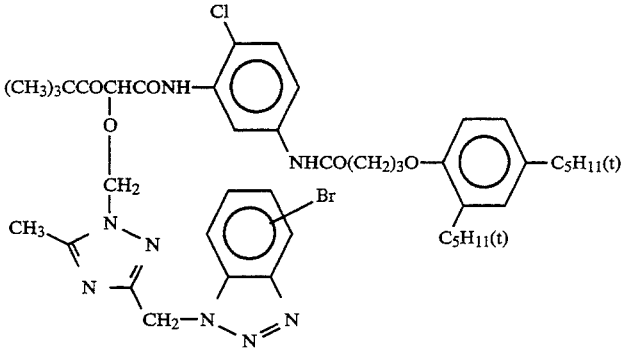
(Coupler (19) as disclosed in JP-A-60-218645)
C-4
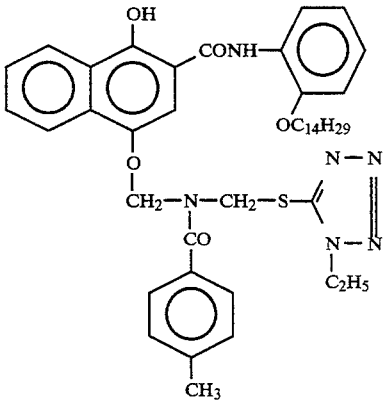
(Coupler (1) as disclosed in JP-A-60-249148)
C-5
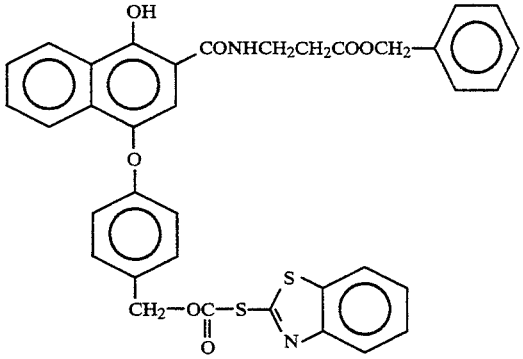
(Coupler (26) as disclosed in JP-A-61-156127)
C-6
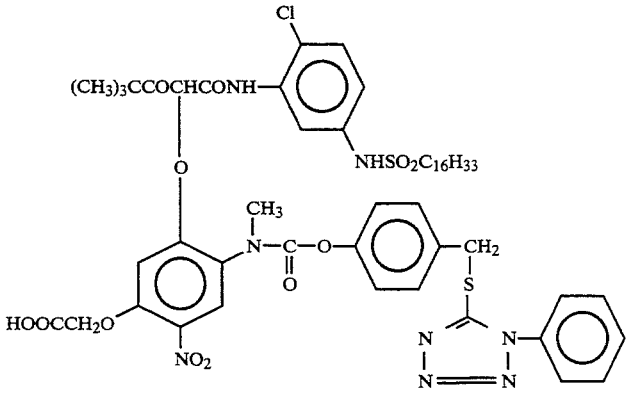
(Compound (5) as disclosed in U.S. Pat. No. 4,861,701)

-continued

C-7

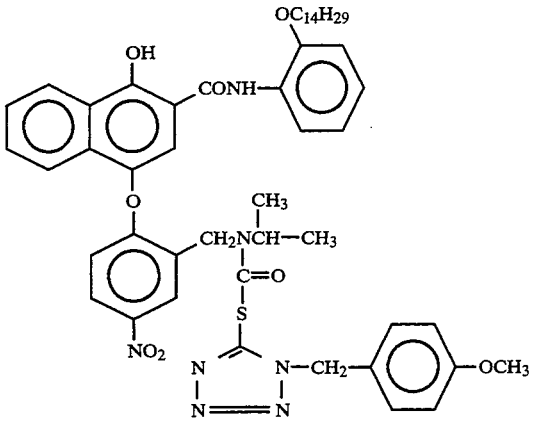

(Compound (2) as disclosed in European Patent Publication 348,139

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising on a support at least a silver halide emulsion layer, comprising a compound represented by general formula (I):

$$A—(L)_2—INH—(CH_2)_n—Q \quad (I)$$

wherein A represents a coupler group excepting 1H-pyrazolo [1,5-b]-1,2,4-triazole and 1H-pyrazolo[5,1-c]-1,2,4-triazole; L represents a timing group selected from the group consisting of

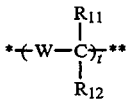

(T-1)

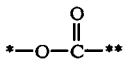

(T-4)

wherein W represents an oxygen atom, a sulfur atom or an

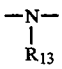

group wherein $R_{13}$ represents substituent group; $R_{11}$ and $R_{12}$ each represents a hydrogen atom or a substituent; t represents an integer of 1 or 2; * represents the position at which it is connected to A or L; and ** represents the position at which it is connected to L or INH; n represents an integer of 0 or 1; Q represents a group having a molecular weight of 90 to 200; wherein when n is 0, Q is an electron donating group-containing aryl group, and when n is 1, Q is an aryl group; and INH represents a development inhibitor group bonded to $A—(L)_2$ via a hereto atom and selected from the group consisting of

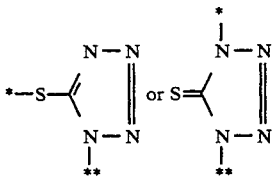

(INH-1)

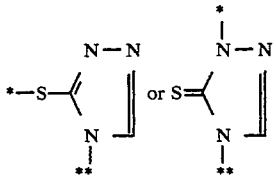

(INH-2)

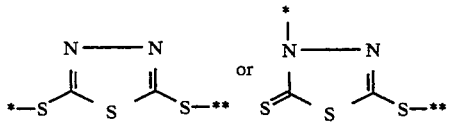

(INH-3)

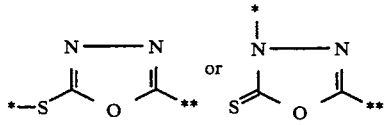

(INH-4)

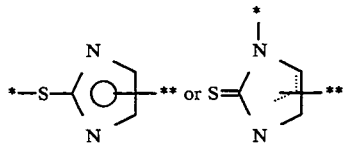

(INH-5)

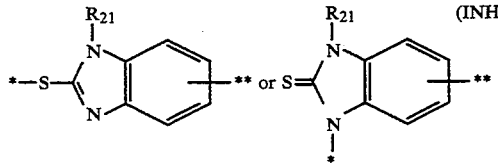

(INH-6)

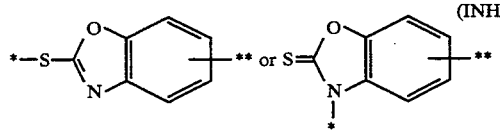

(INH-7)

-continued (INH-8)

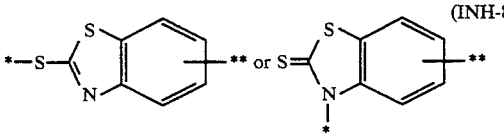

(INH-9)

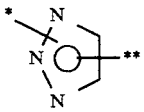

(INH-10)

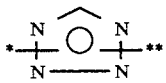

(INH-11)

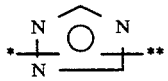

-continued (INH-12)

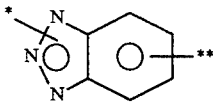

wherein $R_{21}$ represents a hydrogen atom or a substituted or unsubstituted hydrocarbon group; * represents the position at which the group is connected to L and ** represents the position at which the group is connected to $-(CH_2)_n-Q$.

2. The silver halide color photographic material of claim 1, wherein adjacent L groups are different from each other.

3. The silver halide color photographic material of claim 1, wherein the L group connected to A is represented by (T-4) and the L group connected to INH is represented by (T-1).

4. The silver halide color photographic material of claim 1, wherein Q is a group having a molecular weight of 100 to 150.

5. The silver halide color photographic material of claim 1, wherein INH represents (INH-1), (INH-2), (INH-3), (INH-4) or (INH-12).

6. The silver halide color photographic material of claim 5, wherein INH represents (INH-1) or (INH-3).

* * * * *